US005607820A

United States Patent [19]

Nakamura

[11] Patent Number: 5,607,820

[45] Date of Patent: Mar. 4, 1997

[54] METHOD FOR PROCESSING SILVER HALIDE COLOR PHOTOGRAPHIC MATERIAL

[75] Inventor: Koichi Nakamura, Kanagawa, Japan

[73] Assignee: Fuji Photo Film Co., Ltd., Kanagawa, Japan

[21] Appl. No.: 427,834

[22] Filed: Apr. 26, 1995

Related U.S. Application Data

[63] Continuation of Ser. No. 143,380, Oct. 29, 1993, abandoned, which is a continuation of Ser. No. 983,286, Nov. 30, 1992, abandoned, which is a continuation of Ser. No. 610,917, Nov. 9, 1990, abandoned.

[30] Foreign Application Priority Data

Nov. 13, 1989 [JP] Japan ..... 1-294343

[51] Int. Cl.[6] ..... G03C 7/42

[52] U.S. Cl. ..... 430/393; 430/430; 430/460; 430/461; 430/943

[58] Field of Search ..... 430/393, 430, 430/460, 461, 943

[56] References Cited

U.S. PATENT DOCUMENTS

| | | | |
|---|---|---|---|
| 3,042,520 | 7/1962 | Johnson | 430/461 |
| 4,242,442 | 12/1980 | Idota et al. | 430/393 |
| 4,268,618 | 5/1981 | Hashimura | 430/393 |
| 4,277,556 | 7/1981 | Koboshi et al. | 430/943 |
| 4,301,236 | 11/1981 | Idota et al. | 430/393 |
| 4,328,306 | 5/1982 | Idota et al. | 430/943 |
| 4,454,224 | 6/1984 | Brien et al. | 430/943 |
| 4,596,764 | 7/1985 | Ishimaru | 430/393 |
| 4,939,074 | 7/1990 | Ishikawa | 430/393 |
| 4,962,014 | 10/1990 | Ishikawa et al. | 430/393 |
| 4,966,834 | 10/1990 | Ishikawa et al. | 430/393 |

FOREIGN PATENT DOCUMENTS

| | | | |
|---|---|---|---|
| 1026 | 1/1979 | Japan | 430/393 |
| 8706361 | 10/1987 | WIPO . | |

OTHER PUBLICATIONS

Research Disclosure #14836, Aug. 1976.

European Search Report for Application EP 90 12 1624, Dated Dec. 19, 1990.

Annex to the European Search Report on European Application No. EP 90 12 1624, Dated Dec. 19, 1990.

Patent Abstracts of Japan, vol. 12, No. 8, Jan. 12, 1988, JP-A-62 168159.

*Primary Examiner*—Hoa Van Le

*Attorney, Agent, or Firm*—Sughrue, Mion, Zinn, Macpeak & Seas

[57] ABSTRACT

A method for desilvering an imagewise exposed and color development processed silver halide color light-sensitive material comprising processing the imagewise exposed and color developed silver halide color light-sensitive material with a processing solution exhibiting bleaching ability which contains at least one of hydrogen peroxide and a compound capable of releasing hydrogen peroxide, wherein the silver halide color light-sensitive material has an emulsion layer comprising a light-sensitive silver halide with at least 90 mol % silver chloride and substantially no silver iodide, the processing solution exhibiting a bleaching ability contains at least one water-soluble chloride, the color developed silver halide color light-sensitive material contains 1 mmol/m$^2$ or less of a color developing agent in the light-sensitive material when introduced into the processing solution exhibiting a bleaching ability and the desilvering is completed within 30 seconds. The desilvering proceeds rapidly in a stable manner without causing environmental pollution.

15 Claims, No Drawings

METHOD FOR PROCESSING SILVER HALIDE COLOR PHOTOGRAPHIC MATERIAL

This is a continuation of application Ser. No. great-grandparent application Ser. No. 07/610,917 filed Nov. 9, 1990; now abandoned grandparent application Ser. No. 07/983,286 filed Nov. 30, 1992; now abandoned parent application No. 08/143,380 filed Oct. 29, 1993, now abandoned.

FIELD OF THE INVENTION

This invention relates to a method of desilvering a color light-sensitive material containing light-sensitive silver halide and couplers, such as a color paper. More particularly, it relates to a method of rapidly and stably bleaching a silver halide color light-sensitive material without causing environmental pollution.

BACKGROUND OF THE INVENTION

Photographic processing of silver halide color photographic materials basically comprises development (in the case of color reversal materials, color development is preceded by black-and-white first development), desilvering, and washing. Desilvering comprises bleaching and fixing or combined bleach-fixing (blix). The processing further includes supplementary steps, such as stabilization, prebath processing preceding each step, and stopping. In color development, an exposed silver halide is reduced by a color developing agent to form silver and halogen ions. Simultaneously, the oxidized color developing agent reacts with a coupler to form a dye. The developed silver is re-halogenated by bleaching and removed by fixing (or blix) together with undeveloped silver.

Bleaching agents which have been mainly used include red prussiate (potassium ferricyanide) and aminopolycarboxylic acid ferric salts. Potassium ferricyanide is an excellent bleaching agent exhibiting a sufficiently high rate of bleaching but releases cyanide ion on photolytic degradation causing environmental pollution. Therefore, a countermeasure should be taken to make the waste liquid completely harmless. On the other hand, aminopolycarboxylic acid ferric salts are now being used widely because of they cause less environmental pollution and they can be regenerated easily (a ferrous salt is easily oxidized to a ferric salt by contact with air). Nevertheless, if it remains in a light-sensitive material due to insufficient washing, the white background of an image shows increased stain with time. Therefore, a light-sensitive material after bleach or blix should be washed with a sufficient amount of water for a sufficient time. Also with respect to environmental conservation, even an aminopolycarboxylic acid ferric salt is not perfect (e.g., it has a high BOD or COD). Hence, a demand exists for an oxidizing agent having a rapid bleaching power without causing environmental pollution.

Hydrogen peroxide is an ideal oxidizing agent which decomposes into water and does not cause environmental pollution. Various bleaching solutions using hydrogen peroxide have hitherto been proposed. For example, the latest proposals include a bleaching solution or a bleaching method for desilvering using hydrogen peroxide under a neutral to acidic condition (pH 2 to 6) under which a dye image is not substantially formed as disclosed in JP-A-53-23633, JP-A-53-75932, and JP-A-54-1027 (the term "JP-A" as used herein means an "unexamined published Japanese patent application"), and a hydrogen peroxide bleaching solution containing an organic metal complex salt to obtain enhanced bleaching power as disclosed in JP-B-61-16067 and JP-B-61-19024 (the term "JP-B" as used herein means an "examined Japanese patent publication"). However, a hydrogen peroxide bleaching solution has a problem in that bleaching power and liquid stability are not simultaneously achieved. That is, a bleaching solution having increased stability has weak bleaching power, while stability of the hydrogen peroxide in a solution having increased bleaching power is not maintained. In addition, it is extremely difficult to accomplish desilvering within a short time of 30 seconds while maintaining liquid stability.

In order to accelerate bleaching, bleaching or bleach-fix solutions containing hydrogen peroxide together with a compound capable of forming a soluble silver salt with a silver ion under a neutral to alkaline condition have been proposed as disclosed in U.S. Pat. Nos. 4,454,224, 4,717,649, and 4,737,450. These solutions, however, still require a long time for bleaching and are not sufficient to achieve rapid bleach. Moreover, JP-A-53-75932 describes that processing with a bleaching or blix bath containing hydrogen peroxide tends to result in the formation of bubbles which results in a blister phenomenon, particularly on abrupt initiation of the bleaching reaction with silver. That is, in achieving rapid desilvering, compatibility of rapid bleaching reaction with inhibition of blister has been an important subject to consider.

Stability of hydrogen peroxide in an aqueous solution can be increased by addition of a stabilizer, such as sodium pyrophosphate and sodium stannate, as taught, e.g., in *Research Disclosure*, No. 11660 or W.C. Schump, *Hydrogen Peroxide*, pp. 515–547, Reinnold (1955), but the stability attained is still insufficient. Addition of an organic phosphonic acid to an intensifier to improve stability of hydrogen peroxide as disclosed, e.g., in JP-B-56-45131 has been proposed in carrying out intensification of a dye image using hydrogen peroxide. Decomposition of hydrogen peroxide is, in general, catalytically accelerated in the presence of a trace amount of a metal and, as a result, oxygen is released. It is therefore considered that the stability of hydrogen peroxide may be improved by addition of a certain type of sequestering agent (chelating agent). However, even when the decomposition of hydrogen peroxide is inhibited by using such a stabilizer, the formation of bubbles in the liquid on silver bleaching cannot be inhibited, and under certain processing conditions, blisters are easily formed.

Where a light-sensitive material after color development is processed with a hydrogen peroxide-containing solution having a pH of neutrality or higher (e.g., pH 8 or higher), it has turned out that intensification reaction of the dye image preferentially takes place due to a color developing agent which has been carried over by the light-sensitive material. As a result, bleaching of the image silver is retarded and, in particular, an area of low image silver amount (e.g., on a 10 $mg/m^2$ level) is not completely bleached.

Further, bleaching by a hydrogen peroxide-containing bleaching solution is considerably inhibited when the solution is contaminated with even a trace amount of halogen ions dissolved from a light-sensitive material. In actual processing, since as halogen ions are accumulated through continuous running, desilvering insufficiency develops despite a sufficient concentration of hydrogen peroxide being present.

As stated above, many problems remain awaiting solution in using hydrogen peroxide as a practical bleaching agent.

SUMMARY OF THE INVENTION

An object of the present invention is to provide a method for bleaching a color development-processed silver halide color photographic material in a hydrogen peroxide solution rapidly and in a stable manner.

Another object of the present invention is to provide a method for bleaching a color development-processed silver halide color photographic material without blistering or an increase in stain on the white background occurring.

A further object of the present invention is to provide a method for bleaching a color development-processed silver halide color photographic material, which makes it possible to reduce or, in some cases, eliminate waste liquid of the bleaching solution or the bleach-fixing solution and which does not cause any environmental pollution.

After extensive research on rapid desilvering of a color development-processed silver halide color light-sensitive material having a high silver chloride content with a processing solution having a bleaching ability and containing hydrogen peroxide, it has been surprisingly found that rapid desilvering can be achieved in the presence of a specific amount of a chloride with the amount of a color developing agent which has been carried over from a preceding color development step being controlled below a given amount.

That is, the above objects of the present invention are accomplished by a method for desilvering an imagewise exposed and color development processed silver halide color light-sensitive material comprising processing the imagewise exposed and color developed silver halide color light-sensitive material with a processing solution exhibiting a bleaching ability which contains at least one of hydrogen peroxide and a compound capable of releasing hydrogen peroxide, wherein the silver halide color light-sensitive material has an emulsion layer comprising a light-sensitive silver halide with at least 90 mol % silver chloride and substantially no silver iodide, the processing solution exhibiting a bleaching ability contains at least one water-soluble chloride ($M^+Cl^-$), the color developed silver halide color light-sensitive material contains 1 mmol/$m^2$ or less, preferably 0.6 mmol/$m^2$ or less, and more preferably 0.3 mmol/$m^2$ or less, of a color developing agent when the light-sensitive material is introduced into the processing solution exhibiting a bleaching ability.

In the present invention, for rapid processing, it is preferable that the processing solution having a bleaching ability further contains an organic phosphonic acid or a salt thereof (hereinafter inclusively referred to as an organic phosphonic acid compound). It has turned out that addition of the organic phosphonic acid compound not only makes it possible to achieve rapid bleaching while sufficiently retaining the stability of the processing solution but this surprisingly eliminates the blister phenomenon.

When using a conventional light-sensitive material having a high silver bromide content, the presence of a halogen ion in a desilvering system brings marked inhibition of bleaching reaction and no acceleration at all. Further, the blister phenomenon cannot be completely eliminated by addition of an organic phosphonic acid only (i.e., in the absence of a chloride ion). Taking these facts into consideration, it is unexpected that the construction of the present invention achieves desilvering far more rapidly than is achieved with conventional processing methods without blistering occurring.

It has been furthermore found that immersion in a processing solution having a bleaching ability for a long period (e.g., more than 30 seconds) not only results in an increased minimum density ($D_{min}$) but tends to cause blister to occur.

In the present invention, the term "desilvering" as used herein means the process of bleaching or bleach-fixing.

DETAILED DESCRIPTION OF THE INVENTION

The organic phosphonic acid compounds which can be used in the present invention preferably include compounds represented by formulae (I) and (II) shown below.

$$R_1N(CH_2PO_3M_2)_2 \quad (I)$$

wherein M represents a hydrogen atom or a cation imparting water solubility (e.g., an alkali metal (e.g., sodium and potassium) or an ammonium, pyridinium, triethanolammonium or triethylammonium ion); and $R_1$ represents an alkyl group having from 1 to 4 carbon atoms (e.g., methyl, ethyl, propyl, isopropyl, and butyl groups), an aryl group (e.g., phenyl, o-tolyl, m-tolyl, p-tolyl and p-carboxyphenyl groups, and a water-soluble salt of a p-carboxylphenyl group (e.g., sodium salt, potassium salt)), an aralkyl group (e.g., benzyl, β-phenethyl, and o-octamidobenzyl groups, and preferably an aralkyl group having from 7 to 9 carbon atoms), an alicyclic group (e.g., cyclohexyl and cyclopentyl groups), or a heterocyclic group (e.g., pyrrolyldimethyl, pyrrolyldibutyl, benzothiazolylmethyl, and tetrahydroquinolylmethyl groups), each of which (particularly the alkyl group) may be substituted with a hydroxyl group, an alkoxy group (e.g., methoxy and ethoxy groups), a halogen atom (e.g., Cl), $—PO_3M_2$, $—CH_2PO_3M_2$, $—N(CH_2PO_3M_2)_2$, etc., wherein M is as defined above;

$$R_2R_3C(PO_3M_2)_2 \quad (II)$$

wherein M is as defined above; $R_2$ represents a hydrogen atom, the above-defined alkyl, aralkyl, alicyclic or heterocyclic group, $—CHR_4—PO_3M_2$ (wherein M is as defined above; and $R_4$ represents a hydrogen atom, a hydroxyl group or an alkyl group), or $—PO_3M_2$ (wherein M is as defined above); and $R_3$ represents a hydrogen atom, a hydroxyl group, an alkyl group, or the above-defined substituted alkyl group or $—PO_3M_2$ (wherein M is as defined above).

Of the compounds represented by formulae (I) and (II), those of formula (II) are particularly preferred.

Specific examples of the phosphonic acids represented by formula (I) are shown below.

(1) Ethylenediamine-N,N,N',N'-tetramethylenephosphonicAcid
(2) Nitrilo-N,N,N-trimethylenephosphonic Acid
(3) 1,2-Cyclohexanediamine-N,N,N',N'-tetramethylenephosphonic Acid
(4) o-Carboxyaniline-N,N-dimethylenephosphonic Acid
(5) Propylamine-N,N-dimethylenephosphonic Acid
(6) 4-(N-Pyrrolidino)butylamine-N,N-bis(methylenephosphonic Acid)
(7) 1,3-Diaminopropanol-N,N,N',N'-tetramethylenephosphonic Acid
(8) 1,3-Propanediamine-N,N,N',N'-tetramethylenephosphonic Acid
(9) 1,6-Hexanediamine-N,N,N',N'-tetramethylenephosphonic Acid
(10) o-Acetamidobenzylamine-N,N-dimethylenephosphonic Acid
(11) o-Toluidine-N,N-dimethylenephosphonic Acid
(12) 2-Pyridylamine-N,N-dimethylenephosphonic Acid Specific examples of the compounds represented by formula (II) are shown below.

(13) 1-Hydroxyethane-1,1-diphosphonic Acid
(14) Ethane-1,1,1-triphosphonic Acid
(15) 1-Hydroxy-2-phenylethane-1,1-diphosphonic Acid
(16) 2-Hydroxyethane-1,1-diphosphonic Acid
(17) 1-Hydroxyethane-1,1,2-triphosphonic Acid
(18) 2-Hydroxyethane-1,1,2-triphosphonic Acid
(19) Ethane-1,1-diphosphonic Acid
(20) Ethane-1,2-diphosphonic Acid The organic phosphonic acid compound is present in the processing solution having a bleaching ability in an amount of from 10 mg to 50 g/l, and preferably from 100 mg to 20 g/l.

In the present invention, the required desilvering time can be reduced if a color development processed light-sensitive material is washed with water or dipped in neutral or acidic water or a neutral or acidic buffer solution (preferably having a pH ranging from 3 to 7) to remove a color developing agent prior to desilvering.

It is also effective to reduce the uptake of a color developing agent into a light-sensitive material during development processing by appropriately selecting the kind and amount of a binder (e.g., gelatin) or hardening agent used in the light-sensitive material to reduce the thickness of the swollen film or by reducing the amount of high-boiling organic solvent used as a dispersing medium for organic materials. The thickness of the swollen film is preferably 18 μm or less, and more preferably 6 to 15 μm (in water at 38° C). The amount of high-boiling organic solvent is preferably 2 $g/m^2$ or less, and more preferably 0.6 to 1.8 $g/m^2$.

If no substantial intensifying reaction is to take place, removal or reduction of color developing agent in the light-sensitive material to be desilvered is also desirable from the standpoint of suppressing variations in photographic characteristics, such as maximum and minimum densities and gradation, during continuous processing.

In order to reduce carry-over of a color developing agent into a bleaching bath, rapid development is conducted to thereby control the uptake of a color developing agent into the light-sensitive material.

The processing solution having bleaching ability (i.e., a bleaching solution or a blix solution) preferably has a pH ranging from 7 to 13, and more preferably from 8 to 11, since the bleaching reaction rapidly proceeds under a neutral to alkaline condition. If the pH is less than 7, the bleaching reaction is slow.

In the present invention, hydrogen peroxide or a compound capable of releasing hydrogen peroxide is used as a bleaching agent. Compounds capable of releasing hydrogen peroxide include peroxyhydrates, e.g., $Na_2SiO_3.H_2O_2.H_2O$ and $NaBO_2.H_2O_2.3H_2O$, and peroxo compounds, e.g., peroxocarbonates, peroxoborates, peroxosulfates, and peroxophosphates. Specific examples of the peroxo compounds include $Na_2CO_3.H_2O_2.½H_2O$, $K_2C_2O_6$, $Na_2B_4O_7.H_2O_2.9H_2O$, $(NH_4)_2S_2O_8$, $K_2S_2O_8$ and $K_4P_2O_8$.

The amount of hydrogen peroxide or compound capable of releasing hydrogen peroxide used in the processing solution having bleaching ability ranges from 0.03 to 6 mol/l, and preferably from 0.1 to 1.5 mol/l.

Water-soluble chlorides which can be used in the present invention are compounds which release chloride ion in water, represented by formula $M^+Cl^-$ wherein $M^+$ is an alkali metal cation, an alkaline earth metal cation, or a quaternary $N^+$ group. Examples of such compounds include chlorides of an alkali metal (e.g., sodium, potassium, lithium, cesium) or an alkaline earth metal (e.g., magnesium, calcium), and a quaternary $N^+$ type chloride (e.g., ammonium chloride, tetrabutylammonium chloride), with sodium chloride and potassium chloride being particularly preferred.

The above-described water-soluble chloride is added to the processing solution having a bleaching ability in an amount of from 0.005 to 0.3 mol/l, and preferably from 0.01 to 0.1 mol/l.

If desired, the bleaching solution or bleach-fixing solution may contain known nitrogen-containing heterocyclic compounds described in the literature for the purpose of inhibiting an increase in the minimum density ($D_{min}$) due to a bleaching reaction. Examples of such compounds include those described in JP-B-56-48866 and JP-B-56-48867; nitrobenzimidazole derivatives described in U.S. Pat. No. 2,496,940, British Patent 403,789, and U.S. Pat. Nos. 2,497,917 and 2,656,271; benzotriazole derivatives described in *Nihon Shashin Gakkaishi*, Vol. 11, p. 48 (1948); heterocyclic quaternary salts such as benzothiazolium salts described in U.S. Pat. Nos. 2,131,038, 2,694,716, and 3,326,681; tetraazaindene derivatives described in U.S. Pat. Nos. 2,444,605, 2,444,606, and 2,444,607; and other heterocyclic compounds described in U.S. Pat. Nos. 2,173,628, 2,324,123, and 2,444,608. Additional examples are given, e.g., in *Kaqaku Shashin Binran*, Mild. Vol., p. 119, Maruzen (1959).

A color photographic material is preferably subjected to color development, bleach, fixing, and washing (and/or stabilization)in the present invention. After color development, a light-sensitive material is preferably washed with water or immersed in a neutral or acidic buffer solution to remove color developing agent and then subjected to the subsequent processing steps. In other words, it is preferable to minimize carry-over of the color developing agent with a light-sensitive material into the desilvering step as much as is possible, thereby markedly speeding up desilvering.

The color developing solution which can be used in the present invention contains a known aromatic primary color developing agent. The color developing agent preferably is a p-phenylenediamine derivative. Typical but non-limiting examples of p-phenylenediamine developing agents are shown below.

D-1: N, N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl)amino] aniline
D-6: 4-Amino-3-methyl-N-ethyl-N-(3-hydroxypropyl)aniline
D-7: 4-Amino-3-methyl-N-ethyl-N-[β-(methanesulfonamido)ethyl]-aniline
D-8: N-(2-Amino-5-diethylaminophenylethyl-)methanesulfonamide
D-9: N, N-Dimethyl-p-phenylenediamine
D-10: 4-Amino-3-methyl-N-ethyl-N-methoxyethylaniline
D-11: 4-Amino-3-methyl-N-ethyl-N-β-ethoxyethylaniline
D-12: 4-Amino-3-methyl-N-ethyl-N-β-butoxyethylaniline 4-Amino-3-methyl-N-ethyl-N-[β-(methanesulfonamido) ethyl]-aniline (D-7) and 4-amino-3-methyl-N-ethyl-N-(3-hydroxypropyl)aniline (D-6) are particularly preferred of these p-phenylenediamine derivatives.

These p-phenylenediamine derivatives may be in the form of a salt, such as a sulfate, a hydrochloride, a sulfite, and a p-toluenesulfonate salt. The aromatic primary amine developing agent is preferably used in an amount of from about 0.1 g to about 30 g, and more preferably from about 0.5 g to about 15 g, per liter of developing solution.

In carrying out the present invention, it is preferable to use a developing solution containing substantially no benzyl alcohol. The terminology "substantially no benzyl alcohol" as used herein means that the benzyl alcohol concentration is preferably not more than 2 ml/l, more preferably not more than 0.5 ml/l, and most preferably zero.

A developing solution containing substantially no sulfite ion is preferable also serving as a preservative for a developing agent. In addition, sulfite ion has an effect of dissolving silver halide and an effect of reducing dye formation efficiency on reacting with an oxidation product of a developing agent. These effects of sulfite ion seem to be one of causes of an increase of variation in photographic characteristics accompanying continuous processing. The terminology "substantially no sulfite ion" as used herein means that sulfite ion concentration is preferably not more than $3.0\times10^{-3}$ mol/l, and more preferably zero. The sulfite ion as above referred excludes trace amounts of sulfite ion which is used as an antioxidant for a processing kit containing a concentrated developing agent before preparation of a developing solution.

In addition to no substantial sulfite ion being present, the developing solution preferably contains substantially no hydroxylamine. This is because hydroxylamine not only functions as a preservative for a developing solution but has a silver development activity by itself. Therefore, a variation of a hydroxylamine concentration appears to greatly influence the photographic characteristics. The terminology "substantially no hydroxylamine" as used herein means that the amount of hydroxylamine is preferably not more than $5.0\times10^{-3}$ mol/l, and more preferably is zero.

Accordingly, the developing solution preferably contains an organic preservative in place of hydroxylamine or sulfite ion as above-described. The organic preservative referred to herein denotes organic compounds capable of reducing the rate of deterioration of the aromatic primary amine color developing agent, i.e., organic compounds having the function of preventing the oxidation of a color developing agent, e.g., air oxidation. Particularly effective organic preservatives are hydroxylamine derivatives (exclusive of hydroxylamine, hereinafter the same), hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamide compounds, and condensed cyclic amines. Examples of these organic preservatives are described, e.g., in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, and JP-B-48-30496.

If desired, the developing solution may further contain, as a preservative, various metals as described in JP-A-57-44148 and JP-A-57-53749, the salicylic acid derivatives described in JP-A-59-180588, alkanolamines described in JP-A-54-3532, polyethyleneimines described in JP-A-56-94349, aromatic polyhydroxyl compounds described in U.S. Pat. No. 3,746,544, etc. In particular, alkanolamines, e.g., triethanolamine, dialkylhydroxylamines, e.g., diethylhydroxylamine, hydrazine derivatives, or aromatic polyhydroxyl compounds are preferred.

Particularly preferred of the above-described organic preservatives are hydroxylamine derivatives and hydrazine derivatives (i.e., hydrazines and hydrazides). Specific examples of these organic preservatives and their use are described in JP-A-1-97953, JP-A-1-186939, JP-A-1-186940, and JP-A-1-187557.

Use of a combination of the above-described hydroxylamine derivative or hydrazine derivative with an amine is more preferred to improve the stability of the color developing solution which leads to improved stability in continuous processing.

Examples of suitable amines which can be used in this combination include cyclic amines as described in JP-A-63-239447, the amines described in JP-A-63-128340, and the amines described in JP-A-1-186939 and JP-A-1-187557.

The color developing solution to be used in the present invention preferably contains $3.5\times10^{-3}$ to $1.5\times10^{-1}$ mol/l, and particularly from $1\times10^{-3}$ to $1\times10^{-1}$ mol/l, of chloride ion. If more than $1.5\times10^{-1}$ mol/l of chloride ion is present, development tends to be retarded, which is unfavorable for accomplishing the object of the present invention of achieving rapid processing and obtaining a high maximum density. A chloride ion concentration less than $3.5\times10^{-3}$ mol/l is disadvantageous from the standpoint of fog prevention.

Also, the color developing solution to be used in the present invention preferably contains from $1.0\times10^{-5}$ to $1.0\times10^{-3}$ mol/l, and particularly from $5.0\times10^{5}$ to $5\times10^{-4}$ mol/l, of bromide ion. If the amount of bromide ion exceeds $1\times10^{-3}$ mol/l, development is retarded, and the maximum density and sensitivity are reduced. At a bromide ion concentration less than $1.0\times10^{-5}$ mol/l, fog cannot be sufficiently prevented.

The chloride and bromide ions may be directly added to a developing solution or may be supplied through dissolution from the light-sensitive material during development processing. In the former case, suitable chloride ion sources include sodiumchloride., potassium chloride, ammonium chloride, lithium chloride, nickel chloride, magnesium chloride, manganese chloride, calcium chloride, and cadmium chloride, with sodium chloride and potassium chloride being preferred. The chloride ion may also be supplied by a fluorescent brightening agent incorporated into the developing solution.

Suitable bromide ion sources include sodium bromide, potassium bromide, ammonium bromide, lithium bromide, calcium bromide, magnesium bromide, manganese bromide, nickel bromide, cadmium bromide, cerium bromide, thallium bromide, with potassium bromide and sodium bromide being preferred.

In the latter case where chloride and bromide ion are dissolved out of the light-sensitive material, they may be supplied either from the emulsions or other layers of the photographic material.

The color developing solution which can be used in the present invention preferably has a pH between 9 and 12, and more preferably between 9 and 11.0.

The color developing solution may contain various known additives.

For example, various buffering agents are preferably used to maintain the above-described pH range. Examples of suitable buffering agents include carbonates, phosphates, borates, tetraborates, hydroxybenzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, and lysine salts. In particular, carbonates, phosphates, tetraborates, and hydroxybenzoates are preferably used because they have excellent solubility and buffering ability in the high pH range of 9.0 or more, do not adversely influence on the photographic performance (e.g., fog) when present in the color developing solution, and are inexpensive.

Specific but non-limiting examples of these buffering agents are sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent is preferably present in the color developing solution in an amount of 0.1 mol/l or more, and more preferably from 0.1 to 0.4 mol/l.

Various chelating agents can be used in the color developing solution to prevent precipitation of calcium or magnesium or to improve the stability of the developing solution. Examples of suitable chelating agents which can be used include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. These chelating agents may be used either individually or as a combination of two or more thereof.

The chelating agent is present in an amount sufficient for sequestering metallic ions in a color developing solution, usually in an amount of from about 0.1 g to about 10 g per liter.

If desired, a development accelerator may be added to a color developing solution. Examples of suitable development accelerators include thioether compounds as described in JP-B-37-16088, JP-B-37-5987, JP-B-38-7826, JP-B-44-12380, JP-B-45-9019, and U.S. Pat. No. 3,813,247; p-phenylenediamine compounds as described in JP-A-52-49829 and JP-A-50-15554; quaternary ammonium salts as described in JP-A-50-137726, JP-B-44-30074, JP-A-56-156826, and JP-A-52-43429; amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides as described in JP-B-37-16088, JP-B-42-25201, U.S. Pat. No. 3,128,183, JP-B-41-11431, JP-B-42-23883, and U.S. Pat. No. 3,532,501; 1-phenyl-3-pyrazolidones; and imidazoles.

If desired, an antifoggant may also be used in the color developing solution. Examples of suitable antifoggants include alkali metal halides, e.g., sodium chloride, potassium bromide and potassium iodide; and organic antifoggants. Typical examples of the organic antifoggants are nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution preferably contains a fluorescent brightening agent. Examples of suitable fluorescent brightening agents include 4,4'-diamino-2,2'-disulfostilbene compounds. The fluorescent brightening agent is present in an amount of up to 5 g/l, and preferably from 0.1 to 4 g/l.

If desired, various surface active agents, such as alkylsulfonic acids, arylsulfonic acids, aliphatic carboxylic acids, and aromatic carboxylic acids, may also be present in the color developing solution.

Development processing with the above-described Color developing solution is carried out at a processing temperature usually ranging from 20° to 50° C, and preferably from 30° to 40° C for a processing time of from 5 seconds to 2 minutes, and preferably from 10 seconds to 1 minute. The rate of replenishment is preferably as small as possible and suitably ranges from 20 to 600 ml/m$^2$ preferably from 50 to 300 ml/m$^2$ and more preferably from 60 to 200 ml/m$^2$, of photographic material processed.

If desired, the processing solution having a bleaching ability (i.e., bleaching solution or bleach-fix solution) which can be used in the present invention may contain one or more of inorganic or organic acids or alkali metal or ammonium salts thereof having a pH buffer action, e.g., borax, sodium metaborate, acetic acid, sodium acetate, sodium carbonate, potassium carbonate, phosphorous acid, phosphoric acid, sodium phosphate, citric acid, sodium citrate, and tartaric acid; and a corrosion inhibitor, e.g., ammonium nitrate and guanidine.

The fixing agent to be used in the bleaching solution or the bleach-fix solution can be a conventional fixing agent and examples include water-soluble silver halide solvents, such as thiosulfates, e.g., sodium thiosulfate and ammonium thiosulfate; thiocyanates, e.g., sodium thiocyanate and ammonium thiocyanate; thioether compounds, e.g., ethylenebisthioglycolic acid and 3,6-dithia-1,8-octanediol; and thioureas. These fixing agents may be used either individually or as a combination of two or more thereof. A special fixing solution containing a fixing agent in combination with a large quantity of a halide, e.g., potassium iodide, as described in JP-A-55-155354 can also be employed. Fixing agents which are preferably used in the present invention are thiosulfates, and, in particular ammonium thiosulfate is preferred.

The fixing agent is used preferably in an amount of from 0.3 to 2 mol/l, and more preferably from 0.5 to 1.0 mol/l. The fixing solution preferably has a pH of from 3 to 10, and more preferably from 5 to 9.

The bleaching solution and fixing solution may also contain various fluorescent brightening agents, defoaming agents, surface active agents, and organic solvents, e.g., polyvinyl pyrrolidone and methanol.

The fixing solution preferably contains, as a preservative, a sulfite ion-releasing compound, e.g., sulfites (e.g., sodium sulfite, potassium sulfite, ammonium sulfite), bisulfites (e.g., ammonium bisulfite, sodium bisulfite, potassium bisulfite), and metabisulfites (e.g., potassium metabisulfite, sodium metabisulfite, ammonium metabisulfite). These compounds are preferably employed in an amount of from about 0.02 to 0.05 mol/l, and more preferably from 0.04 to 0.40 mol/l, as calculated as sulfite ion.

While a sulfite is generally added as a preservative, other compounds, such as ascorbic acid, a carbonyl-bisulfite addition product, and a carbonyl compound, may also be used as a preservative.

If desired, the fixing solution may further contain a buffering agent, a fluorescent brightening agent, a chelating agent, a defoaming agent, an antifungal agent, and so on.

Desilvering is preferably carried out for 30 seconds or less, more preferably 10 to 30 seconds. The desilvering temperature is usually in the range of from 20 to 45° C, and preferably from 25° to 40° C.

The silver halide color photographic materials, after being subjected to desilvering such as fixing or blix, are generally subjected to washing and/or stabilization.

The amount of washing water to be used in the washing step can vary widely depending on the characteristics of the light-sensitive materials (e.g., the kind of photographic materials such as couplers present), the end use of the light-sensitive materials, the temperature of the washing water, the number of washing tanks (the number of stages), the replenishing system (e.g., counter-flow system or direct-flow system), and other factors. For example, the relationship between the number of washing tanks and the quantity of water in a multi-stage counter-flow system can be determined by the method described in *Journal of the Society of Motion Picture and Television Engineers*, Vol. 64, pp. 248–253 (May, 1955). In general, the number of stages in the multi-stage counter-flow system is preferably from 2 to 6, and more preferably from 2 to 4.

In the multi-stage counter-flow system, the amount of water required can be greatly reduced to, for example, 0.5 to 1 $l/m^2$ or even less, and the effects of the present invention are markedly observed. On the other hand, there is a tendency for bacteria to grow in the tank as the water retention time increases, and the suspended bacterial cells adhere to the light-sensitive materials. This problem can be effectively eliminated by using a method of reducing calcium and magnesium ions in the washing water as described in JP-A-62-288838. Use of bactericides, such as isothiazolone compounds or thiabendazole compounds as described in JP-A-57-8542; chlorine type bactericides, e.g., chlorinated sodium isocyanurate, as described in JP-A-61-120145; benzotriazoles as described in Japanese Patent Application No. 61-267761; a copper ion; and other bactericides described in Hiroshi Horiguchi, *Bokin Bobai no kaqaku*, Sankyo Shuppan (1986), Eisei Gijutsukai (ed.), *Biseibutsu no mekkin, sakkin, bobai qiutsu* Kogyo Gijutsukai (1982), and Nippon Bokin Bobai Gakkai (ed.), *Bokin bobaizai jiten* (1986) is also effective.

The washing water may further contain a surface active agent as a draining agent and a chelating agent, e.g., EDTA., as a hard water softener.

The washing step may be followed by or replaced with stabilization processing. The stabilizing bath to be used contains a compound functioning as an image stabilizer, such as an aldehyde compound (e.g., formaldehyde), a buffering agent for adjustment to a pH suited for dye stabilization, and an ammonium compound. The stabilizing bath may further contain the above-described bactericides or antifungal agents for preventing proliferation of bacteria or providing the processed light-sensitive material with mildew resistance. The stabilizing bath may also contain a surface active agent, a fluorescent brightening agent, and a hardening agent. Where stabilization is conducted in place of washing, any of known stabilizing techniques described, e.g., in JP-A-57-8543, JP-A-58-14834, and JP-A-60-220345 can be utilized. In addition, use of a chelating agent, e.g., 1-hydroxyethylidene-1,1-diphosphonic acid and, ethylenediaminetetramethylenephosphonic acid, is also preferred.

A rinsing bath may also be used as washing water or a stabilizing bath after desilvering.

Washing or stabilization is preferably effected at a pH between 4 and 10, and more preferably between 5 and 8. The temperature is appropriately determined depending on the use or characteristics of the light-sensitive material and usually ranges from 15° to 45° C, and preferably from 20° to 40° C. While the time can be varied, the shorter the time, the better is the reduction in the processing time. The time is preferably from 15 to 105 seconds, and more preferably from 30 to 90 seconds. The rate of replenishment is preferably as low as possible from the standpoint of reducing the operating cost, the waste liquid generated and its handling. A preferred amount of replenisher is from 0.5 to 50 times, and particularly from 3 to 40 times, the amount of the carry-over from the prebath per unit area of the light-sensitive material, or not more than 1 $l/m^2$, and preferably not more than 500 $ml/m^2$. Replenishment may be conducted either continuously or intermittently.

The bath used in the washing and/or stabilization step may be recycled to a preceding step, if desired. For example, the overflow from the washing step, where the amount is reduced by using a multi-stage counter-flow system, may be recycled to the preceding fixing bath while replenishing the fixing bath with a concentrated processing solution to thereby reduce the amount of waste liquid.

The color photographic light-sensitive material which can be used in the present invention usually comprises a support having thereon at least one blue-sensitive silver halide emulsion layer, at least one green-sensitive silver halide emulsion layer, and at least one red-sensitive silver halide emulsion layer. In general, color papers comprise these light-sensitive layers on a support in the order listed above but a different order may be used if desired. An infrared-sensitive silver halide emulsion layer may be used as a replacement for at least one of these emulsion layers, if desired. The light-sensitive emulsion layers each contains a silver halide emulsion sensitive to the different wavelength regions and a color coupler forming a dye of a color complementary to the light to which it is sensitive, that is, a yellow dye to blue light, a magenta dye to green light, and a cyan dye to red light, are present to thereby achieve color reproduction by the subtractive color process. The light-sensitive material may also have a structure in which the light-sensitive layers and the developed hue of the couplers do not have the above-described relationship.

Silver halide emulsions which can be used in the present invention preferably are silver chlorobromide or silver chloride emulsions containing substantially no silver iodide. The terminology "substantially no silver iodide" as used herein means that the amount of silver iodide present is not more than 1 mol %, and preferably not more than 0.2 mol %. While the halogen composition of the silver halide emulsion may be either the same or different in the individual grains, use of an emulsion having the same halogen composition in the grains makes it easy to obtain grains with uniform properties. The halogen composition may be uniformly distributed throughout the individual grains (homogeneous grains), or the individual grains may have a non-uniformly distributed halogen composition to form a laminate structure comprising a core and a single-layered or multi-layered outer shell or may have a non-layered portion differing in halogen composition in the inside or on the surface thereof (when such an area is on the surface, it is fused on the edge, corner or plane of the grains). Either of the latter two types of grains is preferred to homogeneous grains in order to obtain high sensitivity and also from the standpoint of pressure resistance. The boundary between the two layers or areas in these heterogeneous grains differing in halogen composition may be either clear or diffuse while forming mixed crystals due to the difference in composition. Further, the structure may be so designed to have a continuously varying halogen composition.

The silver halide grains in the high silver chloride emulsion preferably have a localized silver bromide layer(s) or areas (hereinafter inclusively referred to as a localized phase(s)) in the inside and/or on the surface of the individual grains. The localized phase preferably has a silver bromide content of at least 10 mol %, and more preferably more than 20 mol %. These localized phases may be present in the inside of the grains or on the surface (e.g., edges, corners, or planes) of the grains. One preferred example is an epitaxially grown area on the corner(s) of grains.

On the other hand, for the purpose of minimizing reduction in sensitivity on application of pressure to a light-sensitive material, a high silver chloride emulsion having a silver chloride content of 90 mol % or higher with its halogen composition being distributed in a narrow range throughout the individual grains is also preferably used.

The silver chloride content of the silver halide emulsions can be further increased to reduce the rate of replenishing the developing solution. In this case, an emulsion comprising nearly pure silver chloride having a silver chloride content of from 98 to 100 mol % is preferably used.

The silver halide grains in the silver halide emulsions preferably have a mean grain size of from 0.1 to 2 μm (the mean grain size is the number average of the diameter of a circle equivalent to the projected area of a grain).

The emulsion is preferably a mono-dispersion in which the grain size distribution has a coefficient of variation (obtained by dividing the standard deviation by the mean grain size) is not more than 20%, and preferably not more than 15%. Two or more kinds of mono-dispersed emulsions may be blended and coated in the same layer or may be separately coated in different layers to obtain a broad tolerance.

The silver halide grains of the photographic emulsions may have a regular crystal form, such as a cubic form, a tetradecahedral form, and an octahedral form; an irregular crystal form, such as a spherical form and a plate form; or a composite crystal form thereof. The grains may be a mixture of various crystal forms. In the present invention, the grains preferably comprise at least 50%, preferably at least 70%, and more preferably at least 90%, of those having a regular crystal form.

In addition, emulsions containing tabular grains having an average aspect ratio (circle-equivalent diameter/thickness ratio) of 5 or more, preferably 8 or more, in a proportion of at least 50% of the total grains expressed in terms of a projected area can also be used to advantage.

The silver chlorobromide emulsions which can be used in the present invention can be prepared by known methods as described in P. Grafkides, *Chemie et Physique Photographique*, Paul Montel (1967), G. F. Duffin, *Photographic Emulsion Chemistry*, The Focal Press (1966), and V. L. Zelikman, et al., *Making and Coating Photographic Emulsion*, The Focal Press (1964). More specifically, the emulsions can be prepared using the acid process, the neutral process, the ammonia process, etc. The reaction between a soluble silver salt and a soluble halogen salt can be carried out by a single jet process, a double jet process, a combination thereof, and the like.

The so-called reverse mixing process in which silver halide grains are formed in the presence of excess silver ions may also be used. The so-called controlled doublet jet process in which the pAg value of a liquid phase in which the silver halide grains are formed is maintained constant, may also be employed. A silver halide emulsion comprising grains having a regular crystal form and a nearly uniform grain size can be prepared using this process.

Various polyvalent metal ion impurities may be introduced into the silver halide emulsions which can be used in the present invention during silver halide grain formation or the subsequent physical ripening. Examples of useful compounds therefor include salts of cadmium, zinc, lead, copper, and thallium; and salts or complex salts of the group VIII metals, e.g., iron, ruthenium, rhodium, palladium, osmium, iridium, and platinum. The group VIII metal compounds are particularly preferred. These compounds are preferably used in an amount of from $1\times10^{-9}$ to $1\times10^{-2}$ mol per mol of silver halide, though the amount can vary widely depending on the end use of the light-sensitive material.

The silver halide emulsions are usually subjected to chemical sensitization and spectral sensitization.

Chemical sensitization of the silver halide emulsions can be achieved by sulfur sensitization represented by the addition of instable sulfur compounds, reduction sensitization, noble metal sensitization represented by gold sensitization or. other known techniques, either alone or as a combination thereof. Compounds which can be preferably used for chemical sensitization are described in JP-A-62-215272, pp. 18–22.

Spectral sensitization is conducted to sensitize the emulsion of each light-sensitive layer to a spectral sensitivity in a desired light wavelength region. Spectral sensitization is preferably carried out by adding a dye which absorbs light of the wavelength region corresponding to the desired spectral sensitivity, i.e., a spectral sensitizing dye. Examples of suitable spectral sensitizing dyes include those described, e.g., in F. M. Harmer, *Heterocyclic Compounds-Cyanine Dyes and Relates Compounds*, John Wiley & Sons, New York, London (1964). Specific examples of preferred sensitizing dyes are described in JP-A-62-215272, pp. 22–38.

Various antifoggants or stabilizers or precursors thereof can be introduced into the photographic emulsions to prevent fog during preparation, preservation or photographic processing of light-sensitive materials or to stabilize the photographic performance properties of the light-sensitive materials. Specific examples of suitable compounds are described in JP-A-62-215272, pp. 39–72.

The emulsions which can be used in the present invention may be either a surface latent image type forming a latent image predominantly on the grain surface or an internal latent image type forming a latent image predominantly on the inside of the grain.

The color light-sensitive materials which can be used in the present invention generally contain yellow, magenta, and cyan couplers which develop yellow, magenta and cyan colors, respectively, on coupling with the oxidation product of an aromatic amine color developing agent.

Cyan, magenta, and yellow couplers which are preferred for use in the present invention are represented by formulae (C-I), (C-II), (M-I), (M-II) and (Y) shown below, respectively.

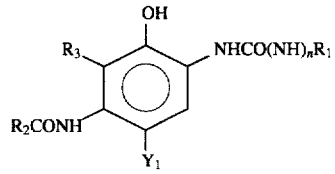

(C-I)

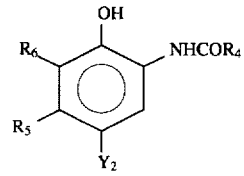

(C-II)

-continued

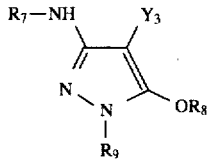

(M-I)

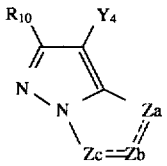

(M-II)

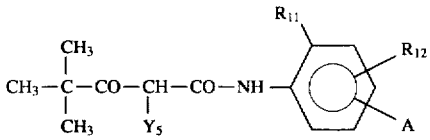

(Y)

In formulae (C-I) and (C-II), $R_1$, $R_2$, and $R_4$ each represents a substituted or unsubstituted aliphatic, aromatic or heterocyclic group; $R_3$, $R_5$, and $R_6$ each represents a hydrogen atom, a halogen atom, an aliphatic group, an aromatic group or an acylamino group; or $R_3$ represents a non-metal atomic group forming a 5- or 6-membered nitrogen-containing ring together with $R_2$; $Y_1$ and $Y_2$ each represents a hydrogen atom or a group releasable on coupling with an oxidation product of a developing agent; and n represents 0 or 1.

$R_5$ in formula (C-II) preferably represents an aliphatic group, e.g., methyl, ethyl, propyl, butyl, pentadecyl, t-butyl, cyclohexyl, cyclohexylmethyl, phenylthiomethyl, dodecyl, oxyphenylthiomethyl, butaneamidomethyl, and methoxymethyl groups.

Of the cyan couplers represented by formula (C-I) or (C-II), the following compounds are preferred.

In formula (C-I), $R_1$ preferably represents an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. When $R_3$ and $R_2$ do not form a ring, $R_2$ preferably represents a substituted or unsubstituted alkyl or aryl group, and more preferably an alkyl group substituted with a substituted aryloxy group, and $R_3$ preferably represents a hydrogen atom.

In formula (C-II), $R_4$ preferably represents a substituted or unsubstituted alkyl or aryl group, and more preferably an alkyl group substituted with a substituted aryloxy group. $R_5$ preferably represents an alkyl group having from 2 to 15 carbon atoms or a methyl group having a substituent containing at least one carbon atom. Substituents for the methyl group preferably include an arylthio group, an alkylthio group, an acylamino group, an aryloxy group, and an alkyloxy group. $R_5$ more preferably represents an alkyl group having from 2 to 15 carbon atoms, particularly from 2 to 4 carbon atoms. $R_6$ preferably represents a hydrogen atom or a halogen atom, and more preferably a chlorine atom or a fluorine atom.

In formulae (C-I) and (C-II), Y1 and Y2 each preferably represents a hydrogen atom, a halogen atom, an alkoxy group, an aryloxy group, an acyloxy group, or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or a releasable group.

In formula (M-I), the substituents for the aryl group (preferably a phenyl group) represented by $R_7$ or $R_9$ are the same as for $R_1$. When two or more substituents are present, they may be the same or different. $R_8$ preferably represents a hydrogen atom, an aliphatic acyl group, or an aliphatic sulfonyl group, and more preferably a hydrogen atom. $Y_3$ preferably represents a group releasable at any of a sulfur, oxygen and nitrogen atom. For example, sulfur-releasable groups as described in U.S. Pat. No. 4,351,897 and International Publication WO 88/04795 are particularly preferred.

In formula (M-II), $R_{10}$ represents a hydrogen atom or a substituent; $Y_4$ represents a hydrogen atom or a releasable group, and preferably a halogen atom or an arylthio group; $Z_a$, $Z_b$, and $Z_c$ each represents a methine group, a substituted methine group, =N—, or —NH—; either one of the $Z_a$—$Z_b$ bond and $Z_b$—$Z_c$ bond is a double bond, with the other being a single bond; when the $Z_b$—$Z_c$ bond is a carbon-carbon double bond, it may be a part of an aromatic ring; and formula (M-II) may form a polymer inclusive of a dimer, at any of $R_{10}$, $Y_4$, or a substituted methine group represented by $Z_a$, $Z_b$ or $Z_c$.

Of the pyrazoloazole couplers of formula (M-II), imidazo[1,2-b]pyrazoles described in U.S. Pat. No. 4,500,630 are preferred from the standpoint of reduced yellow side absorption and fastness to light. Pyrazolo[1,5-b][1,2,4]triazoles described in U.S. Pat. No. 4,540,654 are particularly preferred.

Additional examples of suitable pyrazoloazole couplers include pyrazolotriazole couplers having a branched alkyl group at the 2-, 3- or 6-position of the pyrazolotriazole ring as described in JP-A-61-65245; pyrazoloazole couplers containing a sulfonamido group in the molecule thereof as described in JP-A-61-65246; pyrazoloazole couplers having an alkoxyphenylsulfonamido ballast group as described in JP-A-61-147254; and pyrazolotriazole couplers having an alkoxy group or an aryloxy group at the 6-position as described in European Patent Publication Nos. 226,849 and 294,785.

In formula (Y), $R_{11}$ represents a halogen atom, an alkoxy group, a trifluoromethyl group, or an aryl group; $R_{12}$ represents a hydrogen atom, a halogen atom, or an alkoxy group; A represents —$NHCOR_{13}$, —$NHSO_2$—$R_{13}$, —$SO_2NHR_{13}$, —$COOR_{13}$, or $$-SO_2\underset{\underset{R_{14}}{|}}{N}-R_{13}$$

(wherein $R_{13}$ and $R_{14}$ each represents an alkyl group, an aryl group, or an acyl group); and $Y_5$ represents a releasable group. The substituents for $R_{12}$, $R_{13}$, or $R_{14}$ are the same as for $R_1$. The releasable group $R_5$ is preferably a group releasable at an oxygen atom or a nitrogen atom, and more preferably a nitrogen-releasable group. Specific examples of the couplers represented by formulae (C-I), (C-II), (M-I), (M-II), and (Y) are shown below.

(C-1)
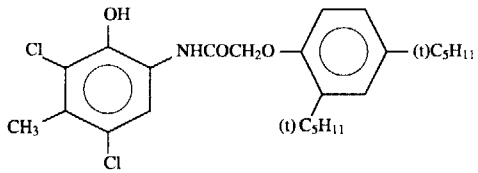
(C-2)
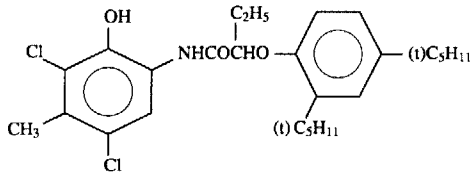
(C-3)
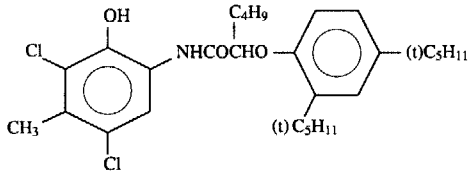
(C-4)
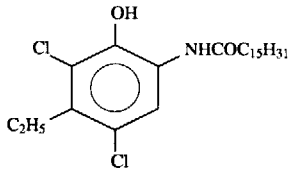
(C-5)
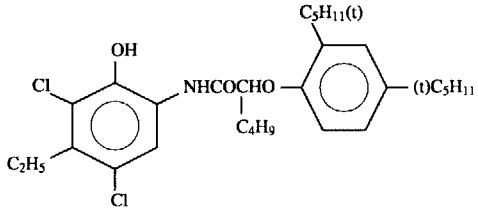
(C-6)
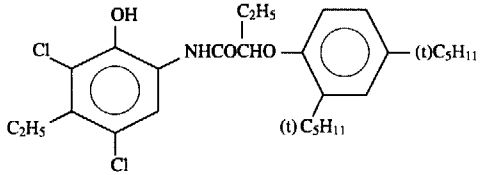
(C-7)
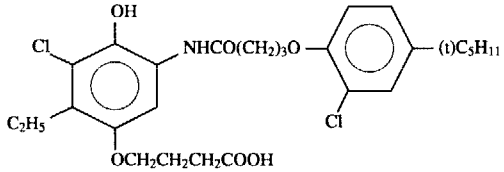
(C-8)
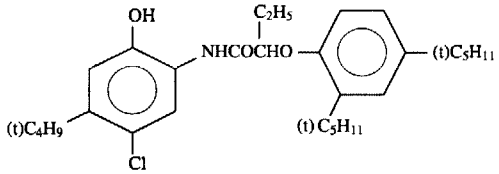
(C-9)
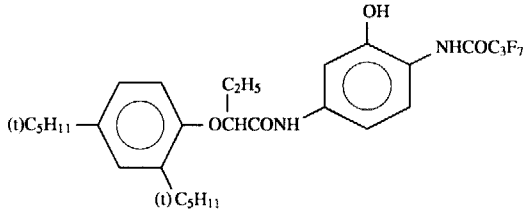
(C-10)
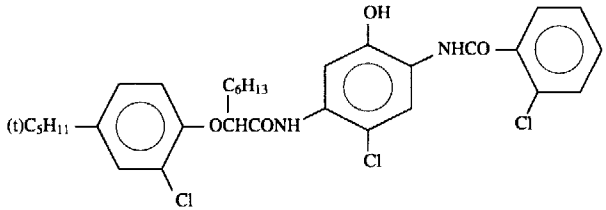

-continued
(C-11)
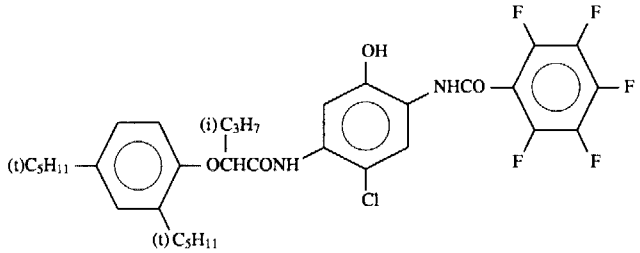
(C-12)
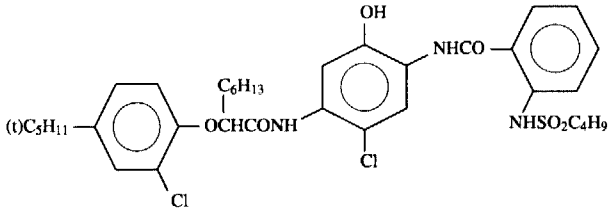
(C-13)
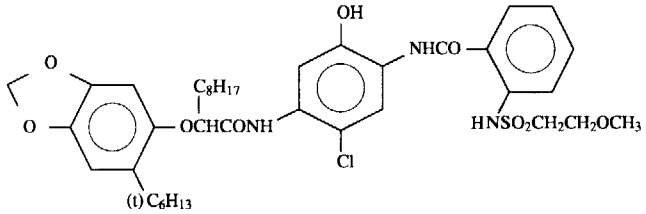
(C-14)
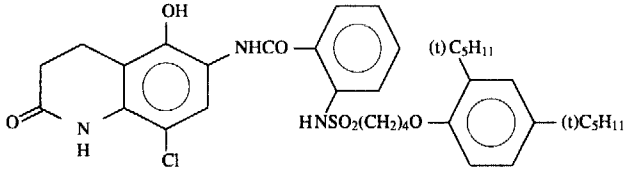
(C-15)
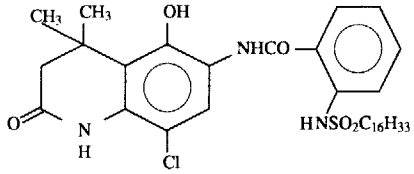
(C-16)
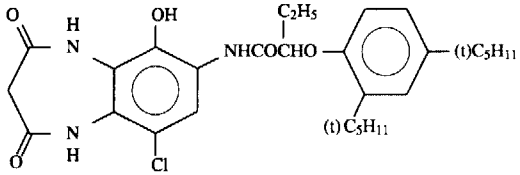
(C-17)
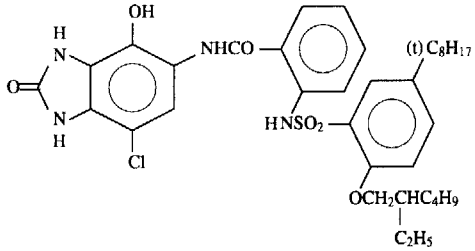
(C-18)
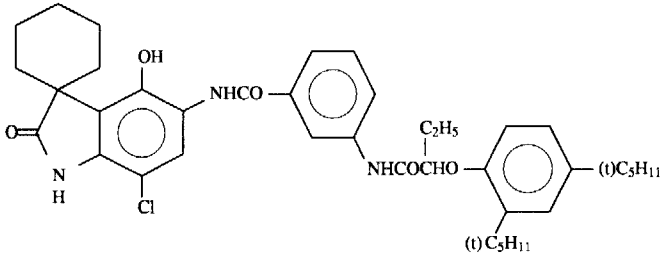
(C-19)
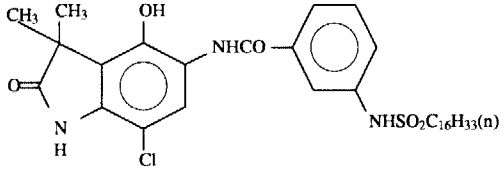
(C-20)
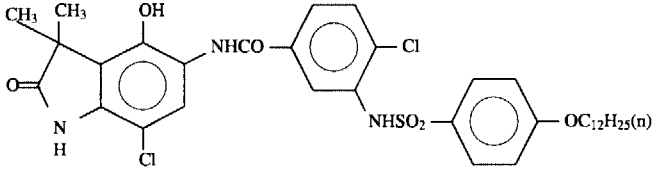

-continued
(C-21)
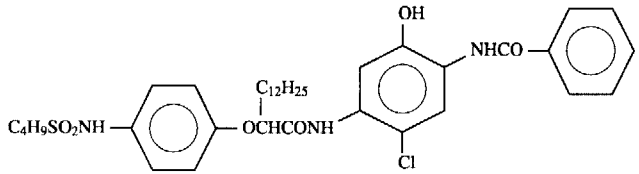
(C-22)
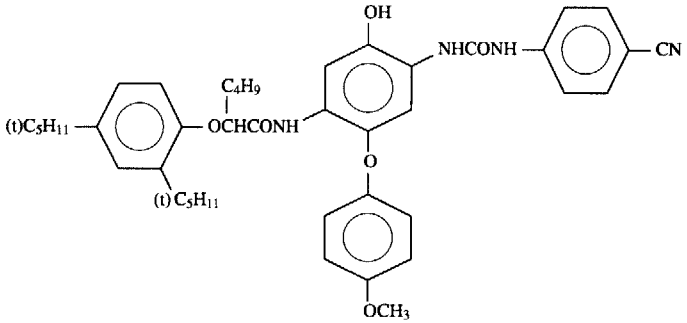
(M-1)
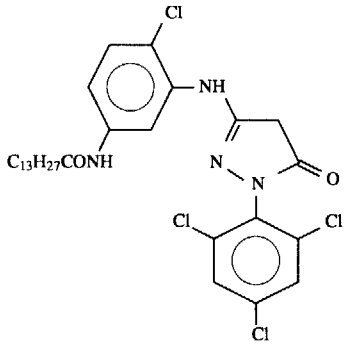
(M-2)
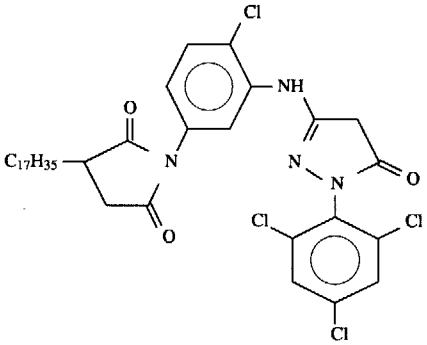
(M-3)
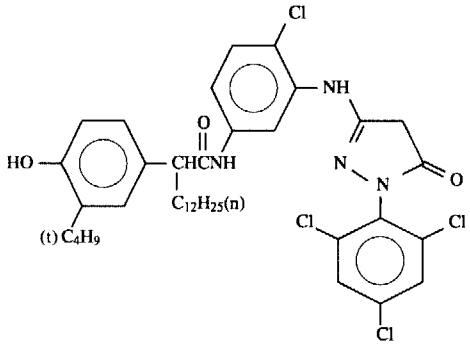
(M-4)
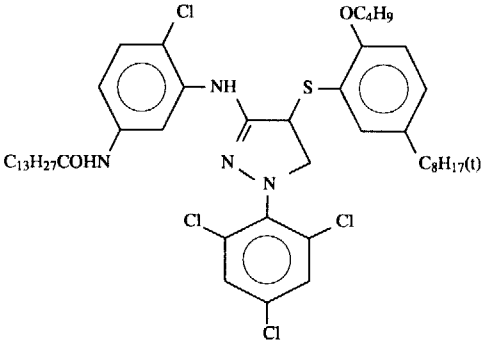

-continued
(M-5)
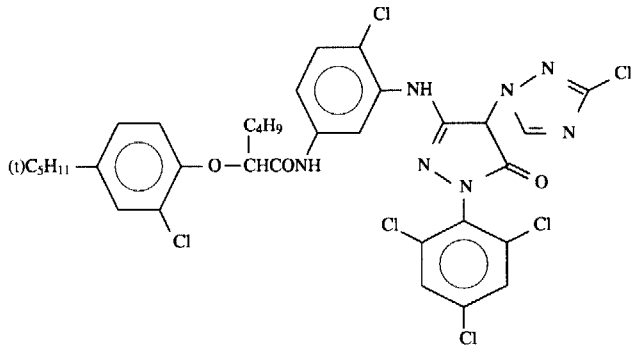
(M-6)
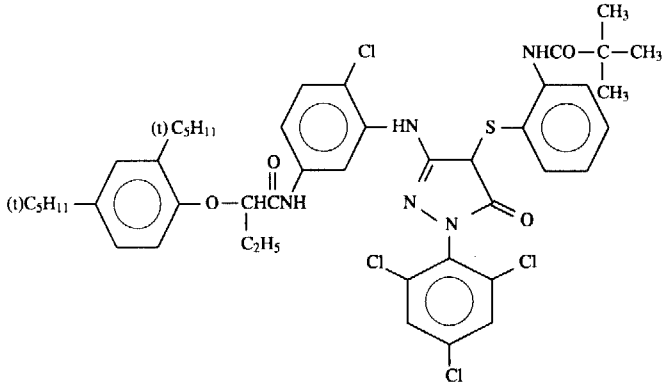
(M-7)
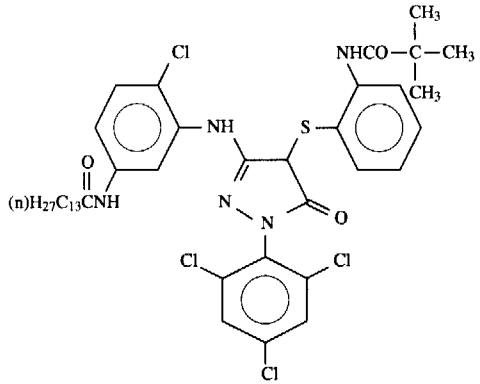
(M-8)
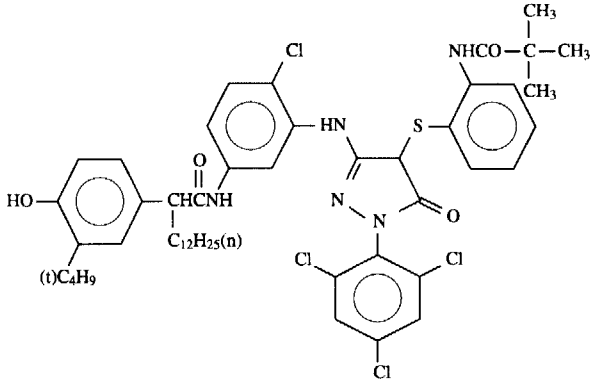

-continued
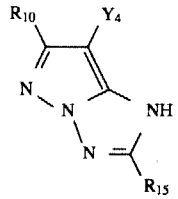
| compound | $R_{10}$ | $R_{15}$ | $Y_4$ |
|---|---|---|---|
| M-9 | $CH_3-$ | 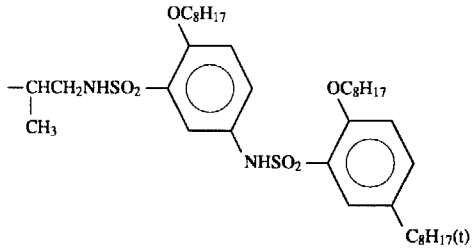 | Cl |
| M-10 | " | 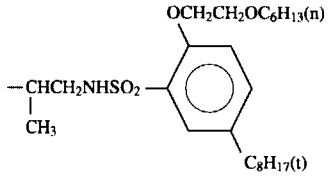 | " |
| M-11 | $(CH_3)_3C-$ | 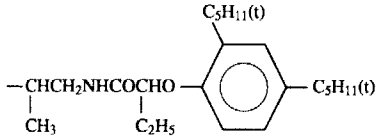 | 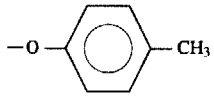 |
| M-12 | 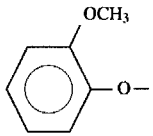 | 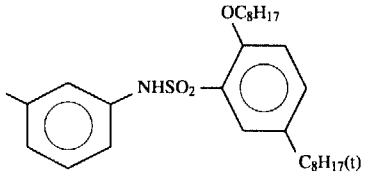 | 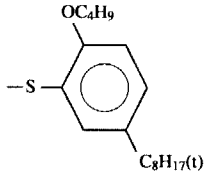 |

-continued
| | | | |
|---|---|---|---|
| M-13 | $CH_3-$ | 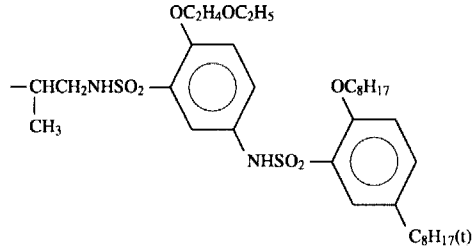 | Cl |
| M-14 | " | 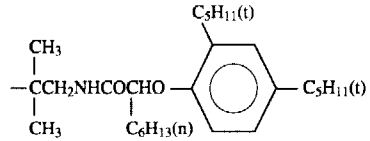 | " |
| M-15 | " | 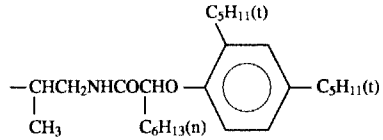 | " |
| M-16 | $CH_3-$ | 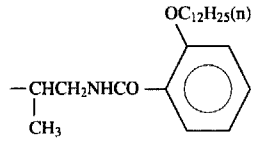 | Cl |
| M-17 | " | 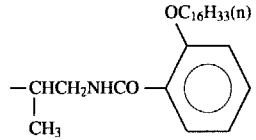 | " |

-continued
| | | | |
|---|---|---|---|
| M-18 | 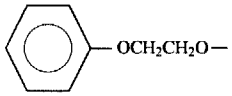 | 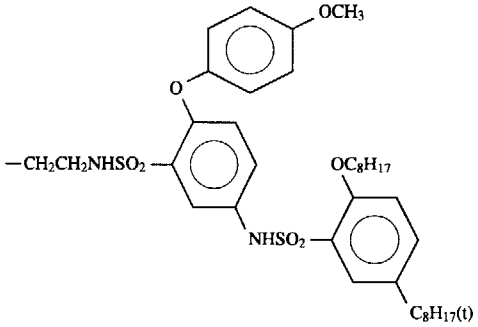 | 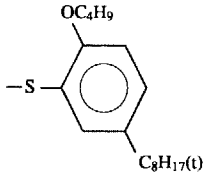 |
| M-19 | $CH_3CH_2O-$ | " | " |
| M-20 | 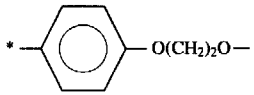 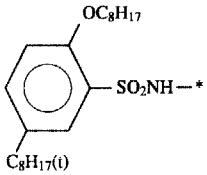 | 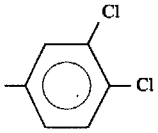 | 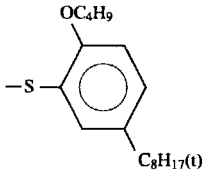 |
| M-21 | 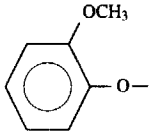 | 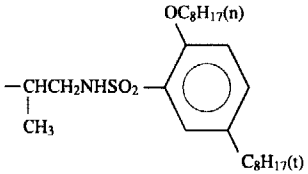 | Cl |

-continued
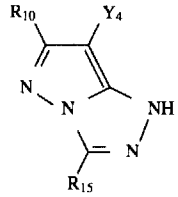
| compound | $R_{10}$ | $R_{15}$ | $Y_4$ |
|---|---|---|---|
| M-22 | $CH_3-$ | 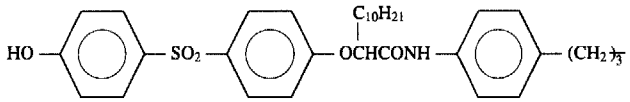 | Cl |
| M-23 | " | 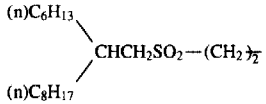 | " |
| M-24 | 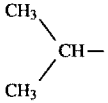 | 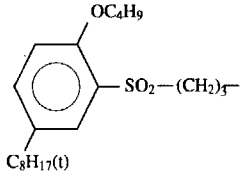 | " |
| M-25 | 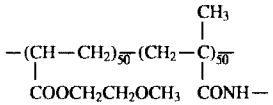 | 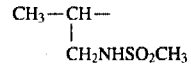 | " |
| M-26 | 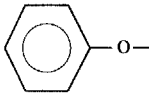 | 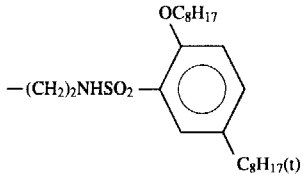 | Cl |

-continued
| | | | |
|---|---|---|---|
| M-27 | $CH_3-$ | 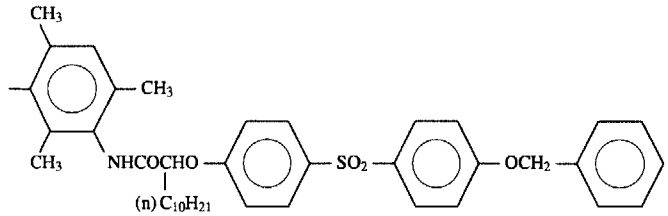 | " |
| M-28 | $(CH_3)_3C-$ | 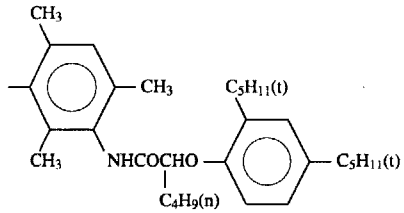 | " |
| M-29 | 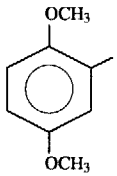 | 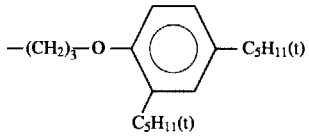 | Cl |
| M-30 | $CH_3-$ | 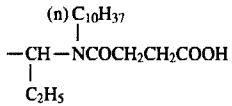 | " |

-continued
(Y-1)
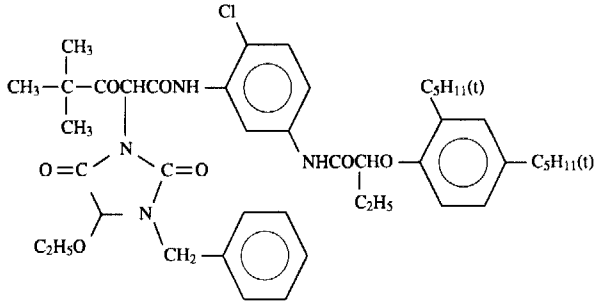
(Y-2)
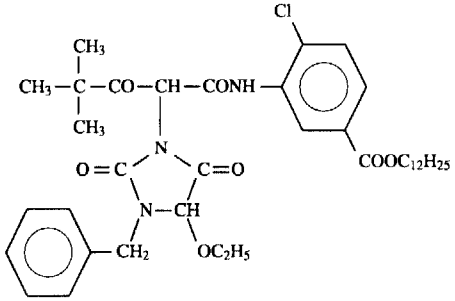
(Y-3)
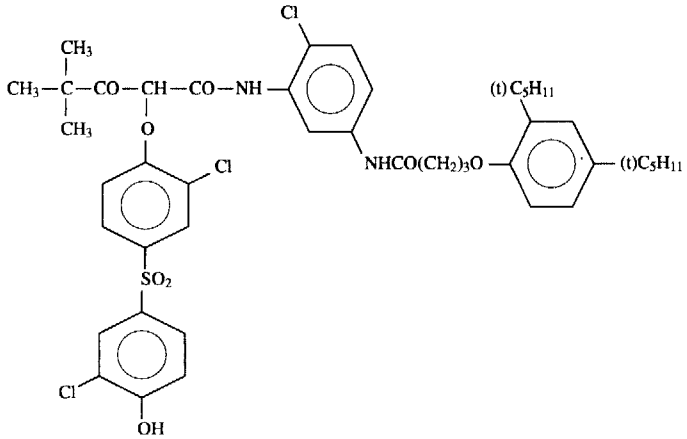
(Y-4)
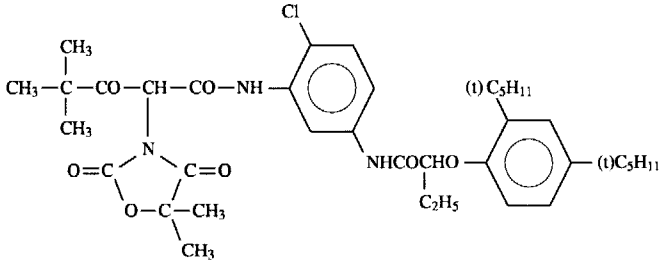
(Y-5)
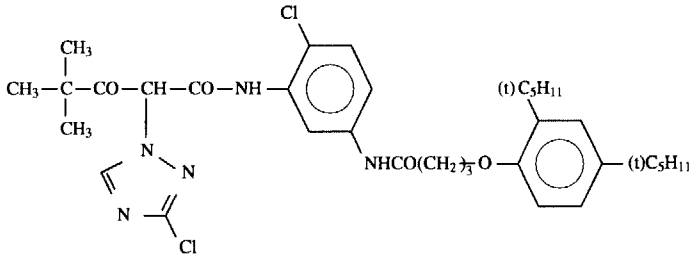
(Y-6)
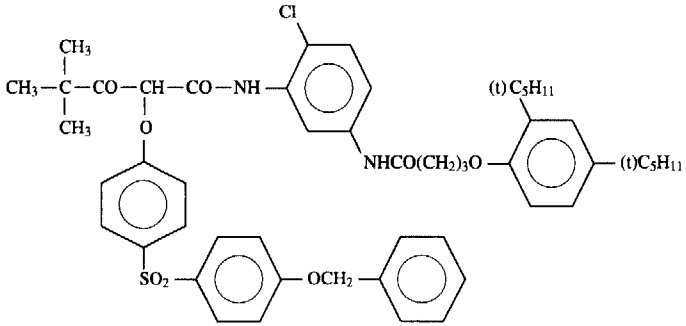

-continued
(Y-7)
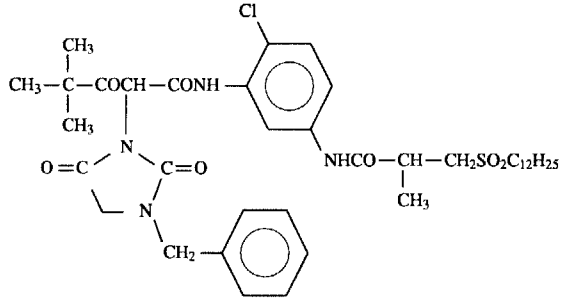
(Y-8)
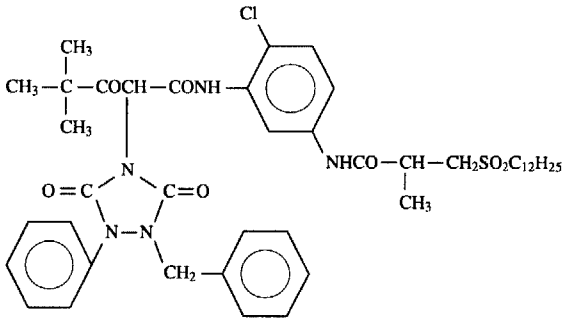
(Y-9)
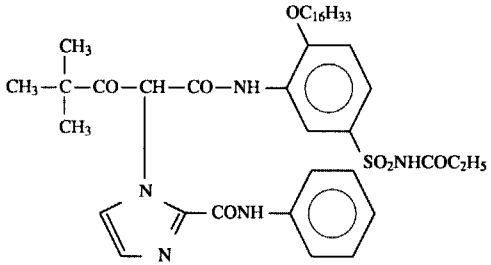

The coupler represented by formula (c-I), (c-II), (M-I), (M-II) or (Y) is present in a light-sensitive silver halide emulsion layer in an amount usually of from 0.1 to 1.0 mol, and preferably from 0.1 to 0.5 mol, per mol of silver halide.

The coupler can be incorporated into a light-sensitive layer using various known methods. The coupler is generally added using an oil-in-water dispersion method known as an oil protection method, in which it is dissolved in a solvent and then emulsified and dispersed in a gelatin aqueous solution containing a surface active agent. Alternatively, water or a gelatin aqueous solution may be added to a coupler solution containing a surface active agent to obtain an oil-in-water dispersion through phase reversal. An alkali-soluble coupler may be dispersed by using the so-called Fischer's dispersion method. Any low-boiling organic solvent present in the coupler dispersion may be removed by distillation, noodle washing, ultrafiltration or a like technique before mixing the dispersion with a photographic emulsion.

The dispersing medium which can be used in the above-described dispersion methods preferably include high-boiling organic solvents and/or water-insoluble high polymeric compounds having a dielectric constant (at 25° C) of from 2 to 20 and a refractive index (at 25° C) of from 1.5 to 1.7.

Suitable high-boiling organic solvents preferably include those represented by formula (A) to (E).

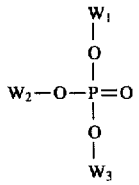

(A)

$$W_1-COO-W_2 \quad (B)$$

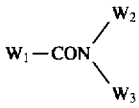

(C)

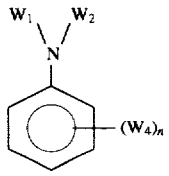

(D)

$$W_1-O-W_2 \quad (E)$$

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S—W_1$; and n represents an integer of from 1 to 5; when n is 2 or greater, the plural $W_4$'s may be the same or different; $W_1$ and $W_2$ in formula (E) may form a condensed ring.

In addition to the compounds of formulae (A) to (E), water-immiscible high-boiling organic solvents having a melting point of not higher than 100° C and a boiling point of not lower than 140° C may also be used as long as they are good solvents for couplers. The high-boiling organic solvents to be used preferably have a melting point of 80° C or lower and a boiling point of 160° C or higher, and more preferably 170° C or higher.

The details of these high-boiling organic solvents are disclosed in JP-A-62-215272, pp. 137–144.

It is also possible to impregnate the coupler into a loadable latex polymer (described, e.g., in U.S. Pat. No. 4,203,716) in the presence or absence of the above-described high-boiling organic solvent or dissolved in a water-insoluble and organic solvent-soluble polymer and emulsified and dispersed in a hydrophilic colloid aqueous solution. The homoor copolymers described in International Publication WO 88/00723, pp. 12–30 are preferably employed. In particular, acrylamide polymers are preferred from the standpoint of dye image stability.

The light-sensitive material which can be used in the present invention may contain hydroquinone derivatives, aminophenol derivatives, gallic acid derivatives, ascorbic acid derivatives, etc. as a color fog inhibitor.

The light-sensitive material may also contain various discoloration inhibitors. Examples of suitable organic discoloration inhibitors for cyan, magenta and/or yellow images include hydroquinones, 6-hydroxychromans, 5-hydroxycoumarans, spirochromans, p-alkoxyphenols, hindered phenols chiefly including bisphenols, gallic acid derivatives, methylenedioxybenzenes, aminophenols, hindered amines, and ether or ester derivatives of these phenol compounds obtained by silylating or alkylating the phenolic hydroxyl group thereof. Metal complexes, such as (bissalicylaldoximato)nickel complexes and (bis-N,N-dialkyldithiocarbamato)nickel complexes, are also useful.

Specific examples of these organic discoloration inhibitors are the hydroquinones described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; the 6-hydroxychromans, 5-hydroxycoumarans, and spirochromans disclosed in U.S. Pat. Nos. 3,432,300, 3,573,050, 3,574,627, 3,698,909, and 3,764,337, and JP-A-52-152225; spiroindanes disclosed in U.S. Pat. No. 4,360,589; p-alkoxyphenols disclosed in U.S. Pat. No. 2,735,765, British Patent 2,066,975, JP-A-59-10539, and JP-B-57-19765; hindered phenols disclosed in U.S. Pat. No. 3,700,455, JP-A-52-72224, U.S. Pat. No. 4,228,235, and JP-B-52-6623; gallic acid derivatives, methylenedioxybenzenes, and aminophenols disclosed in U.S. Pat. Nos. 3,457,079 and 4,332,886, and JP-B-56-21144; hindered amines disclosed in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and metal complexes disclosed in U.S. Pat. Nos. 4,050,938 and 4,241,155 and British Patent 2,027,731(A). These compounds are co-emulsified together with the coupler in an amount usually of from 5 to 100% by weight based on the coupler and added to a light-sensitive layer.

An ultraviolet absorbent can be incorporated into a cyan-forming layer and both layers adjacent thereto to more effectively present fading of a cyan dye image due to heat and particularly light.

Examples of suitable ultraviolet absorbents include benzotriazole compounds having an aryl substituent as described, e.g., in U.S. Pat. No. 3,533,794.; 4-thiazolidone compounds as described, e.g., in U.S. Pat. Nos. 3,314,794 and 3,352,681; benzophenone compounds as described, e.g., in JP-A-46-2784; cinnamic ester compounds as described, e.g., in U.S. Pat. Nos. 3,705,805 and 3,707,395; butadiene compounds as described, e.g., in U.S. Pat. No. 4,045,229; and benzoxydol compounds as described, e.g., in U.S. Pat. Nos. 3,406,070, 3,677,672, and 4,271,307. Ultraviolet absorbing couplers (e.g., α-naphthol type cyan-forming couplers) or ultraviolet absorbing polymers are also useful. These ultraviolet absorbents may be mordanted in a specific layer. Of these ultraviolet absorbents, preferred are benzotriazole compounds having an aryl substituent.

The above-described couplers, particularly pyrazoloazole couplers are preferably used in combination with (F) a compound capable of chemically bonding to residual aromatic amine developing agent remaining after color development to form a chemically inactive and substantially colorless compound and/or (G) a compound capable of chemically bonding to a residual oxidation product of an aromatic amine developing agent remaining after color development to form a chemically inactive and substantially colorless compound. Such a combined use is advantageous to prevent staining and other side effects during preservation after processing which are due to a colored dye formation reaction between residual color developing agent or an oxidation product thereof and the coupler.

Compounds (F) preferably include compounds which react with p-anisidine with a rate constant of a second-odor reaction $k_2$ falling within a range of from 1.0 l/mol.sec to $1\times10^{-5}$ l/mol.sec (in trioctyl phosphate at 80° C.). The rate constant can be determined by the method described in JP-A-63-158545.

When $k_2$ is greater than the above range, the compound per se tends to be labile and to decompose on reacting with gelatin or water. Where $k_2$ is smaller than that range, the reaction with residual aromatic amine developing agent is too slow to prevent side effects due to the residual aromatic amine developing agent.

Preferred of compounds (F) are those represented by formulae (FI) and (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 1 or 0; A represents a group capable of reacting with an aromatic amine developing agent to form a chemical bond; X represents a group which is released on reaction with an aromatic amine developing agent; B represents a hydrogen atom, an aliphatic group, an aromatic group, a heterocyclic group, an acyl group, or a sulfonyl group; and Y represents a group which accelerates addition of an aromatic amine developing agent to the compound (FII); and $R_1$ and X, or Y and $R_2$ or B may combine to form a cyclic structure.

The mode of chemically bonding to residual aromatic amine developing agent typically includes a substitution reaction and an addition reaction.

Specific examples of compounds of formulae (FI) and (FII) preferably include those described in JP-A-63-158545, JP-A-62-283338, and European Patent Publication Nos. 298321 and 277589.

Compounds (G) preferably include those represented by formulae (GI):

$$R-Z \quad \text{(GI)}$$

wherein R represents an aliphatic group, an aromatic group, or a heterocyclic group; and Z represents a nucleophilic group or a group capable of releasing a nucleophilic group on decomposition in a light-sensitive material.

In formula (GI), Z is preferably a group having a Pearson's nucleophilicity "$CH_3I$ value (see R.G. Pearson, et al., *J. Am. Chem. Soc.*, Vol. 90, p. 319 (1968)) of 5 or more or a group derived therefrom.

Specific examples of compounds represented by formula (GI) preferably include those described in European Patent Publication No. 255722, JP-A-62-143048, JP-A-62-229145, JP-A-1-230039 and JP-A-1-57259, European Patent Publication Nos. 298321 and 277589.

Combinations of compounds (G) and compounds (F) are described in detail in European Patent Publication No:. 277589.

The hydrophilic colloidal layers of the light-sensitive material may contain water-soluble dyes or dyes which become water-soluble by photographic processing as a filter dye or to prevent irradiation or halation or for other various purposes. These dyes include oxonol dyes, hemioxonol dyes, styryl dyes, merocyanine dyes, cyanine dyes, and azo dyes. In particular, oxonol dyes, hemioxonol dyes, and merocyanine dyes are useful.

Binders or protective colloids which can be used in the emulsion layers include gelatin advantageously. Other hydrophilic colloids may also be used either alone or in combination with gelatin.

The gelatin to be used in the present invention may be either lime-processed gelatin or acid-processed gelatin. The details of the preparation of gelatin are described in Arthur Vice, *The Macromolecular Chemistry of Gelatin*, Academic Press (1964).

Supports which can be generally used in the light-sensitive material include transparent films commonly employed in photographic light-sensitive materials, e.g., a cellulose nitrate film and a polyethylene terephthalate film, and a reflective support. A reflective support is preferred for accomplishing the object of the present invention.

The terminology "reflective support" as used herein means a support having increased reflecting properties resulting in the dye image formed in the silver halide emulsion layers being more distinct. Such a reflective support includes a support having coated thereon a hydrophobic resin having dispersed therein a light reflecting substance, e.g., titanium oxide, zinc oxide, calcium carbonate, and calcium sulfate; and a support made from a hydrophobic resin having dispersed therein the above-described light reflecting substance. Specific examples of suitable reflective supports include baryta paper, polyethylene-coated paper, polypropylene type synthetic paper; and transparent supports, e.g., a glass plate, a polyester film (e.g., polyethylene terephthalate, cellulose triacetate, cellulose nitrate), a polyamide film, a polycarbonate film, a polystyrene film, and a vinyl chloride resin film, having thereon a reflective layer or containing therein a reflective substance.

In addition, a support with a metallic surface exhibiting specular reflection or diffused reflection of the second kind can also be used as a reflective support. The term "diffused reflection of the second kind" as used herein is defined, for example, in *Shikisai-Kaqaku Handbook*, 5th Ed., Chapter 18, Para. 1, edited by Nippon Shikisai Gakkai and published by Tokyo University Shuppan-Kai (1985). The metallic surface preferably has a spectral reflectance of 0.5 or more in the visible wavelength region. Diffused reflection is obtained by roughening the metal surface or by using a powdered metal. Suitable metals include aluminum, tin, silver, magnesium or alloys thereof. The surface may be made of a metallic plate, foil, or thin film formed by rolling, vacuum evaporation, plating, etc. A support comprising a non-metallic material having formed thereon a metal deposit by vacuum evaporation is preferred. The metallic surface preferably has thereon a water-resistant resin layer, and especially a thermoplastic resin layer. An antistatic layer is preferably provided on the side of the support opposite the metallic surface. The details of such a support having a metallic surface are described, e.g., in JP-A-61-210346, JP-A-63-24247, JP-A-63-24251, and JP-A-63-24255.

The above-described various supports are selected depending on the end use.

The light reflecting substance which can be used in the reflective support preferably includes a white pigment sufficiently kneaded in the presence of a surface active agents. The pigment particles are preferably pre-treated with a di- to tetrahydric alcohol.

The ratio (%) of the area occupied by white pigment particles per unit area is obtained most typically by dividing an observed area into adjacent unit areas each of 6 μm×6 μm and determining the ratio of the area (%, $R_i$) occupied by the fine particles projected on each unit area. A coefficient of variation of the area ratio (%) can be calculated from the ratio of a standard deviation (s) of $R_i$ to the average ($\overline{R}$) of $R_i$, i.e., $s/\overline{R}$. The number (n) of unit areas subject to determination is preferably 6 or more. Accordingly, the coefficient of variation $s/\overline{R}$ can be obtained from:

$$\sqrt{\frac{\sum_{i=1}^{n}(R_i-\overline{R})^2}{n-1}} \Big/ \frac{\sum_{i=1}^{n} R_i}{n}$$

The pigment fine particles to be used in the present invention preferably have a coefficient of variation ($s/\overline{R}$) of not more than 0.15, and more preferably not more than 0.12. Those particles having a $s/\overline{R}$ of 0.08 or less are considered uniformly dispersed.

The present invention makes it feasible to conduct bleaching in a reduced time while using a bleaching solution which does not cause environmental pollution. Moreover, the present invention provides a method of bleaching a silver halide photographic material to provide an image of satisfactory quality free from stain, blisters, etc. even on continuous running.

The present invention is now illustrated in greater detail by way of the following Examples, but it should be understood that the present invention is not deemed to be limited thereto. Unless otherwise indicated therein, all parts percents, ratios and the like are by weight.

EXAMPLE 1

The layers shown below were coated on a polyethylene-laminated (both sides) paper support in the order listed to prepare a multi-layer color paper. The coating compositions were prepared as follows.

Preparation of First Layer Coating Composition:

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 7.4 g of a solvent (Solv-3) to form a solution. The resulting solution was emulsified and dispersed in 185 ml of a 10% gelatin aqueous solution containing 8 ml of 10% sodium dodecylbenzenesulfonate.

Separately, a cubic silver chlorobromide emulsion having a mean grain size of 0.70 μm and a variation coefficient of size distribution of 0.10 and locally containing 0.2 mol % of silver bromide on the grain surface was prepared, and each of the blue-sensitive sensitizing dyes shown below was added thereto in an amount of $2.5\times10^{-4}$ mol/mol-Ag. The thus spectrally sensitized emulsion was then subjected to sulfur sensitization.

The above-prepared emulsified dispersion and the finished emulsion were mixed to prepare a First Layer coating composition having the composition shown below.

Coating compositions for the Second to Seventh Layers were also prepared in the same manner as for the First Layer coating composition. To each coating composition, 1-hydroxy-3,5-dichloro-s-triazine sodium salt was added as a gelatin hardening agent in an amount of 1.8 wt % of gelatin. The spectral sensitizing dyes used in each light-sensitive layer and their amounts are shown below.

Blue-Sensitive Emulsion Layer:

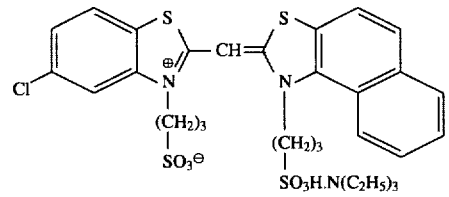

$2.5\times10^{-4}$ mol/mol-AgX (X: halogen)

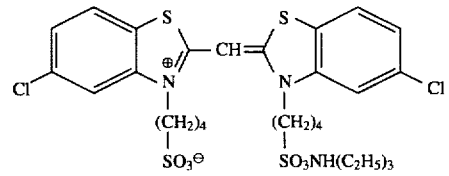

$2.5\times10^{-4}$ mol/mol-AgX

Green-Sensitive Emulsion Layer:

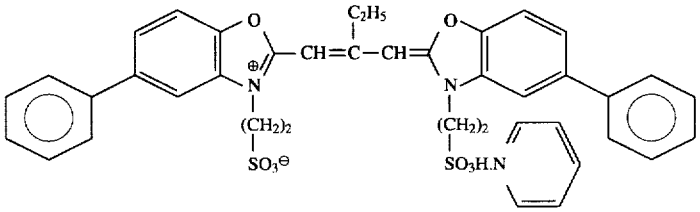

$5.6\times10^{-4}$ mol/mol-AgX

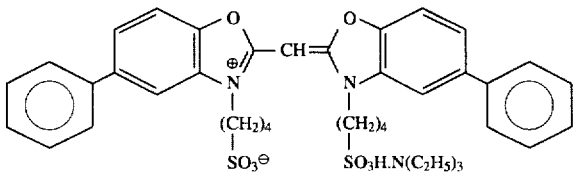

$1.0\times10^{-5}$ mol/mol-AgX

Red-Sensitive Emulsion Layer:

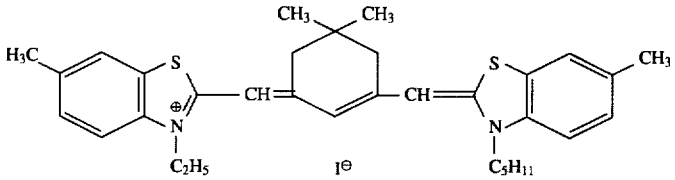

$1.1 \times 10^{-4}$ mol/mol-AgX

To the coating composition for a red-sensitive emulsion layer was further added a compound shown below in an amount of $2.6\times10^{-3}$ mol/mol-AgX.

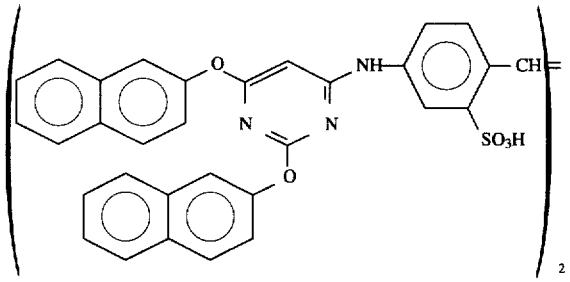

To each of the coating compositions for the blue-, green- and red-sensitive emulsion layers was further added 1-(5-methylureidophenyl)-5-mercaptotetrazole in an amount of $8.5\times10^{5}$ mol, $7.7\times10^{-4}$ mol, and $2.5\times10^{-4}$ mol, respectively, per mol of AgX.

The following dyes were added to the emulsion layers to prevent irradiation.

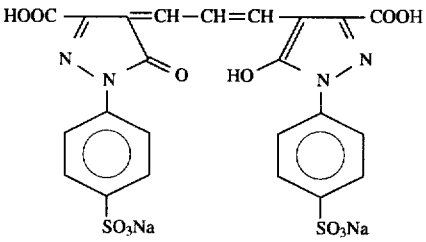

(10 mg/m²)

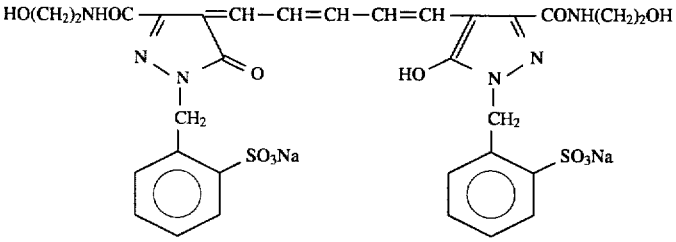

(20 mg/m²)

The layer structure of the multi-layer color paper is shown below. The amount of a silver halide emulsion is shown as a silver coverage (g/m²).

Layer Structure:

Support:

Polyethylene-laminated paper, the polyethylene layer on the side to be coated with the First Layer contained 14.7 wt % of a white pigment ($TiO_2$) and 0.3 wt % of a bluing dye (ultramarine).

| | Amount (g/m²) |
|---|---|
| First Layer (Blue-Sensitive Layer): | |
| Above-Described Silver Chlorobromide Emulsion | 0.30 |
| Gelatin | 1.86 |
| Yellow Coupler (ExY) | 0.82 |
| Dye Image Stabilizer (Cpd-1) | 0.19 |
| Solvent (Solv-3) | 0.32 |
| Dye Image Stabilizer (Cpd-7) | 0.06 |
| Second Layer (Color Mixing Preventive Layer): | |
| Gelatin | 0.99 |
| Color Mixing Inhibitor (Cpd-5) | 0.08 |
| Solvent (Solv-1) | 0.10 |
| Solvent (Solv-4) | 0.05 |
| Third Layer (Green-Sensitive Layer): | |
| Silver chlorobromide emulsion (cubic grains; mean grain size: 0.39 μm; coefficient of variation of size distribution: 0.08; locally containing 0.8 mol% of AgBr on the | 0.12 |

-continued

| | Amount (g/m²) |
|---|---|
| grain surface) | |
| Gelatin | 1.24 |
| Magenta Coupler (ExM) | 0.20 |
| Dye Image Stabilizer (Cpd-2) | 0.03 |
| Dye Image Stabilizer (Cpd-3) | 0.15 |
| Dye Image Stabilizer (Cpd-4) | 0.02 |
| Dye Image Stabilizer (Cpd-9) | 0.02 |
| Solvent (Solv-2) | 0.32 |

| | Amount ($g/m^2$) |
|---|---|
| Fourth Layer (Ultraviolet Absorbing Layer): | |
| Gelatin | 1.58 |
| Ultraviolet Absorbent (UV-1) | 0.47 |
| Color Mixing Inhibitor (Cpd-5) | 0.05 |
| Solvent (Solv-5) | 0.15 |
| Fifth Layer (Red-Sensitive Layer): | |
| Silver chlorobromide emulsion (cubic grains; mean grain size: 0.45 μm; coefficient of variation of size distribution: 0.11; locally containing 0.6 mol% of AgBr on the grain surface) | 0.23 |
| Gelatin | 1.34 |
| Cyan Coupler (ExC) | 0.32 |
| Dye Image Stabilizer (Cpd-6) | 0.17 |
| Dye Image Stabilizer (Cpd-7) | 0.40 |
| Dye Image Stabilizer (Cpd-8) | 0.04 |
| Solvent (Solv-6) | 0.12 |
| Sixth Layer (Ultraviolet Absorbing Layer): | |
| Gelatin | 0.53 |
| Ultraviolet Absorbent (UV-1) | 0.16 |
| Color Mixing Inhibitor (Cpd-5) | 0.02 |
| Solvent (Solv-5) | 0.05 |
| Seventh Layer (Protective Layer): | |
| Gelatin | 1.33 |
| Acryl-Modified Copolymer of Polyvinyl Alcohol (degree of modification: 17%) | 0.17 |
| Liquid Paraffin | 0.03 |

The couplers and other photographic additives used above are shown below.

Yellow Coupler (ExY):

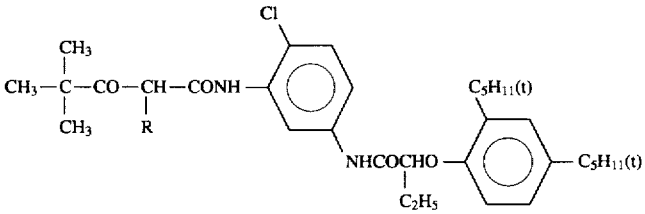

(wherein R: 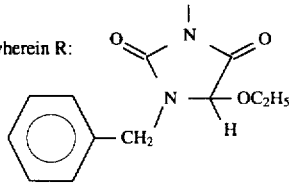 and 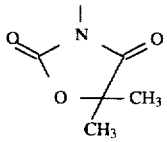 =1:1 by mol)

Magenta coupler (ExM):

1:1 (by mol) mixture of:

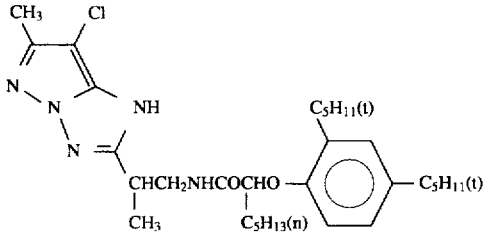

and

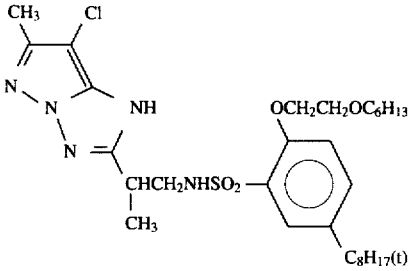

Cyan Coupler (ExC):

2:4:4 (by weight) mixture of:

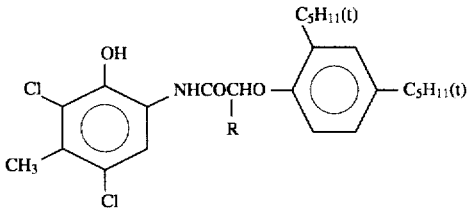

(wherein R: $C_2H_5$ and $C_4H_9$)

and

-continued

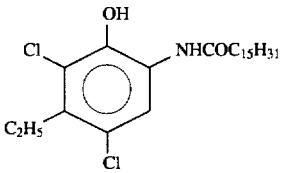

Dye Image Stabilizer (Cpd-1):
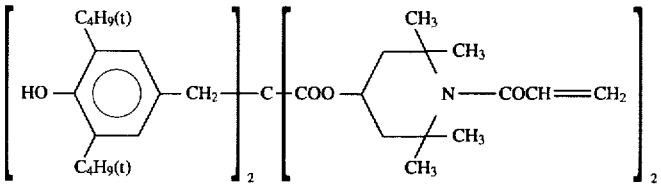
Dye Image Stabilizer (Cpd-2):
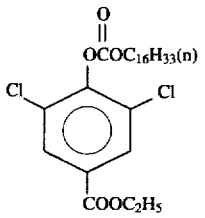
Dye Image Stabilizer (Cpd-3):
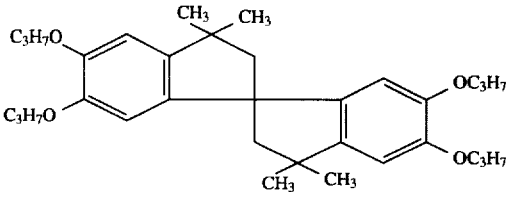
Dye Image Stabilizer (Cpd-4):
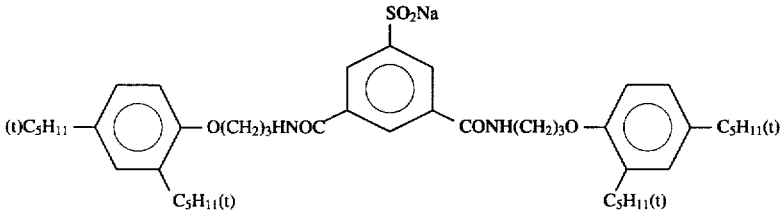
Color Mixing Inhibitor (Cpd-5):
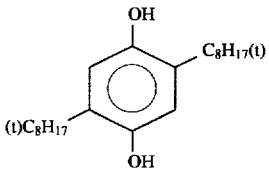
Dye Image Stabilizer (Cpd-6):
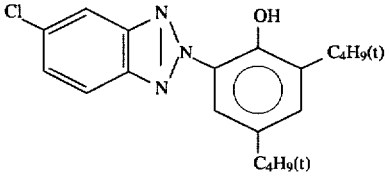
-continued
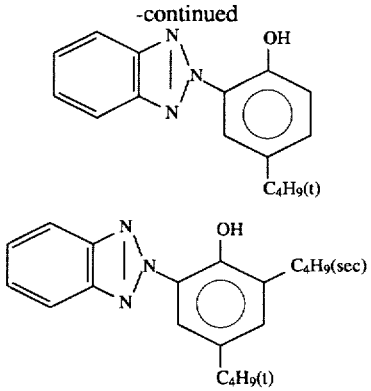
Dye Image Stabilizer (Cpd-7):
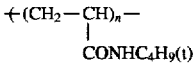
-continued
(Average Molecular Weight: 60,000)
Dye Image Stabilizer (Cpd-8):
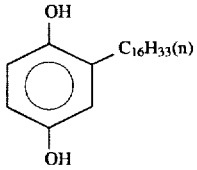

Dye Image Stabilizer (Cpd-9):

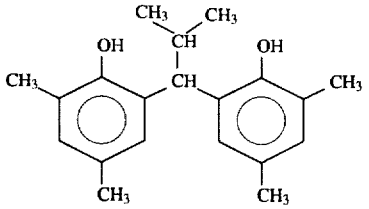

Ultraviolet Absorbent (UV-1):

4:2:4 (by weight) mixture of:

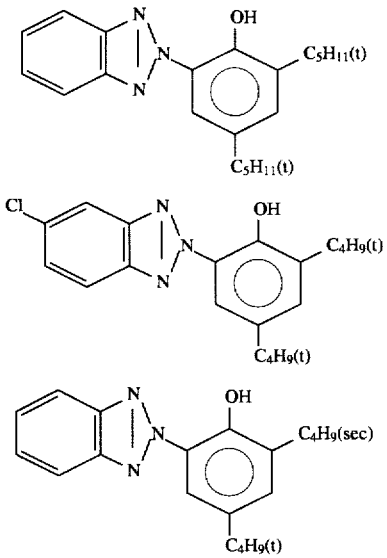

Solvent (Solv-1):

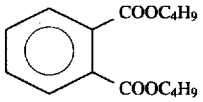

Solvent (Solv-2):

2:1 (by volume) mixture of:

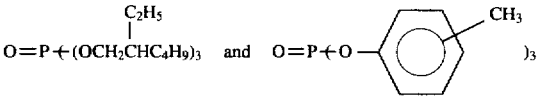

Solvent (Solv-3):

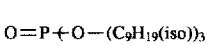

Solvent (Solv-4):

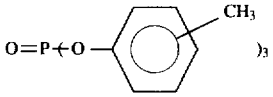

Solvent (Solv-5):

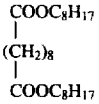

Solvent (Solv-6):

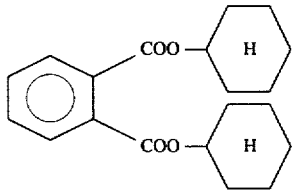

Each of the thus prepared samples was imagewise exposed to light through an optical wedge using a sensitometer ("FWH Model" manufactured by Fuji Photo Film Co., Ltd.; color temperature of light source: 3200° K.) for 0.1 second in an exposure amount of 250 CMS.

Each exposed sample was processed according to the following schedule using processing solutions having the following compositions, with the composition of a bleaching bath being varied as shown in Table 1 below.

The amount of color developing agent which was carried over into the bleaching bath was greatly reduced by using the above-described hardening agent in an amount larger than usual to reduce the thickness of the swollen film and also by conducting development processing at an elevated temperature for a reduced time.

| Processing Step | Temperature | Time |
|---|---|---|
| Color Development | 42° C. | 10 sec |
| Bleach | 35° C. | 15–50 sec |
| Fixing | 30–35° C. | 10 sec |
| Washing | 30–35° C. | 10 sec |
| Drying | 70–80° C. | 20 sec |

| Color Developing Solution: | |
|---|---|
| Water | 800 ml |
| Ethylenediamine-N,N,N,N-tetramethylene-phosphonic Acid | 2.0 g |
| Triethanolamine | 8.0 g |
| Potassium Bromide | 15 mg |
| Sodium Chloride | 1.4 g |
| Potassium Carbonate | 20 g |
| Sodium Hydrogen Carbonate | 4.0 g |
| Fluorescent Brightening Agent ("WHITEX 4B" produced by Sumitomo Chemical Co., Ltd.) | 1.0 g |
| Diethylhydroxylamine (80% aqueous solution) | 6.3 g |
| Sodium Sulfite | 0.1 g |
| 4-Amino-3-methyl-N-ethyl-N-(3-hydroxypropyl)-aniline 2-p-toluenesulfonate | 9.5 g |
| Water to make | 1000 ml |
| pH (25° C.) | 10.05 |
| Fixing Solution: | |
| Anhydrous hypo (sodium thiosulfate) | 160 g |
| Potassium Pyrosulfite | 15 g |
| Sodium Acetate (Anhydrous) | 18 g |
| Boric Acid | 3.5 g |
| Sodium Citrate | 2.5 g |
| Water to make | 1000 ml |

-continued

| Bleaching Solution: | |
|---|---|
| Potassium Carbonate | 21 g |
| Potassium Hydrogen Carbonate | 6 g |
| Hydrogen Peroxide (30% aqueous solution) | 50 ml |
| Sodium Chloride | see Table 1 |
| Organic Phosphonic Acid Compound (30% aqueous solution) | see Table 1 |
| Water to make | 1000 ml |
| pH (25° C.) | 10.00 |
| Washing Water: | |
| Tap Water | |

The density of the resulting image in the unexposed area, i.e., the minimum density ($D_{min}$), was measured through a B, G, or R filter. In order to evaluate desilvering performance, the residual silver amount in the maximum density area of the processed sample was analyzed using a fluorescent X-ray method. Blistering on the image surface was observed using a reflection microscope. The results obtained are shown in Table 1 below.

TABLE 1

| Run No. | Sodium Chloride (mol/l) | Organic Phosphonic Acid Compound (30% Aq. Soln.) Kind | Amount (g/l) | Time of Bleach (sec) | $D_{min}$ B | G | R | Amount of Residual Silver (mg/m²) | Blistering | Remark |
|---|---|---|---|---|---|---|---|---|---|---|
| 1 | 0 | (13) | 4 | 15 | 0.10 | 0.08 | 0.12 | 450 | — | Comparison |
| 2 | 0 | (13) | 4 | 50 | 0.25 | 0.17 | 0.16 | 300 | — | " |
| 3 | 0.004 | (13) | 4 | 15 | 0.10 | 0.08 | 0.12 | 50 | — | Invention |
| 4 | 0.004 | (13) | 4 | 50 | 0.24 | 0.17 | 0.16 | 10 | — | Comparison |
| 5 | 0.035 | (13) | 4 | 15 | 0.10 | 0.08 | 0.11 | ≦5 | — | Invention |
| 6 | 0.035 | (13) | 4 | 30 | 0.13 | 0.10 | 0.13 | ≦5 | — | " |
| 7 | 0.035 | (13) | 4 | 50 | 0.25 | 0.17 | 0.16 | ≦5 | — | Comparison |
| 8 | 0.4 | (13) | 4 | 15 | 0.10 | 0.08 | 0.11 | 40 | — | Invention |
| 9 | 0.4 | (13) | 4 | 50 | 0.26 | 0.17 | 0.16 | 10 | — | Comparison |
| 10 | 0.035 | — | 0 | 30 | 0.13 | 0.10 | 0.12 | ≦5 | observed | Invention |
| 11 | 0 | (1) | 4 | 30 | 0.14 | 0.11 | 0.13 | 350 | " | Comparison |
| 12 | 0.035 | (1) | 4 | 30 | 0.14 | 0.11 | 0.14 | ≦5 | not observed | Invention |
| 13 | 0.035 | (7) | 4 | 30 | 0.14 | 0.11 | 0.13 | ≦5 | not observed | Invention |
| 14 | 0.035 | (13) | 4 | 30 | 0.13 | 0.10 | 0.13 | ≦5 | not observed | " |
| 15 | 0.035 | (17) | 4 | 30 | 0.13 | 0.10 | 0.12 | ≦5 | not observed | " |

Note: The amount of the color developing agent present in the color development processed light-sensitive material was 0.6 mmol/m² (measurement was conducted by removing the liquid on the surface using a stream of $N_2$ and extracting the residual color developing agent into acetic acid and ethyl acetate.

As is apparent from the results in Table 1, the presence of a certain amount of sodium chloride in the bleaching solution markedly accelerates bleaching and the presence of an organic phosphonic acid compound in the bleaching solution eliminates blistering on the image surface. It was thus shown that the present invention makes more rapid silver bleaching feasible without blistering occurring. The results also show that a bleaching processing time exceeding 30 seconds results in an increase in minimum density.

When the above-described testing was repeated on multilayer color paper samples prepared in the same manner as described above, except for replacing the high silver chloride emulsion with a silver chlorobromide emulsion having a silver bromide content of 20 mol %, bleaching was not completed within 60 seconds with any of the bleaching solutions. That is, a light-sensitive material comprising a high silver chloride emulsion is essential before the effects of the present invention can be observed.

EXAMPLE 2

The same light-sensitive material as used in Example 1 was exposed to light in the same manner as in Example 1.

The exposed sample was processed according to the following schedule using the processing solutions shown below. In this example, bleaching was preceded by prebath processing which was carried out for various times to vary the amount of the color developing agent carried over into the subsequent bleaching bath.

| Processing Step | Temperature | Time |
|---|---|---|
| Color Development | 35° C. | 20 sec. |
| Prebath | 35° C. | 0–30 sec |
| Bleaching | 35° C. | 20 sec |
| Fixing | 30–35° C. | 10 sec |
| Washing | 30–35° C. | 10 sec |
| Drying | 70–80° C. | 20 sec |

| Color Developing agent: | |
|---|---|
| Water | 800 ml |
| Ethylenediamine-N,N,N,N-tetramethylene-phosphonic Acid | 2.0 g |
| Triethanolamine | 8.0 g |
| Potassium Bromide | 10 mg |
| Sodium Chloride | 1.4 g |
| Potassium Carbonate | 20 g |
| Sodium Hydrogen Carbonate | 4.0 g |
| Fluorescent Brightening Agent ("WHITEX 4B" produced by Sumitomo Chemical Co., Ltd.) | 1.0 g |
| N,N-bis(Carboxymethyl)hydrazine | 5.5 g |
| Sodium Sulfite | 0.1 g |
| 4-Amino-3-methyl-N-ethyl-N-β-methane-sulfonamidoethylaniline.3/2sulfate.1hydrate | 9.5 g |
| Water to make | 1000 ml |
| pH (25° C.) | 10.05 |

-continued

| | |
|---|---|
| Prebath (I): | |
| Water | |
| Prebath (II): | |
| 0.1M Sodium Citrate | 700 ml |
| Hydrochloric Acid (0.1N) | 300 ml |
| pH (25° C.) | 4.45 |
| Bleaching Solution: | |
| Potassium Carbonate | 21 g |
| Potassium Hydrogen Carbonate | 6 g |
| Hydrogen Peroxide (30% aqueous solution) | 50 ml |
| Sodium Chloride | 2 g |
| 1-Hydroxyethylidene-1,1-diphosphonic Acid (30% aqueous solution) | 4 g |
| Water to make | 1000 ml |
| pH (25° C.) | 10.00 |

Fixing Solution:

The same as in Example 1.

The thus processed sample was evaluated in the same manner as in Example 1. The results obtained are shown in Table 2 below.

TABLE 2

| Run No. | Prebath | Immersion Time in Prebath (sec) | Uptake of Color Developing Agent in Sample Before Bleaching (mmol/m$^2$) | Amount of Residual Silver (mg/m$^2$) | Remark |
|---|---|---|---|---|---|
| 16 | (I) | 0 | 1.5 | 350 | Comparison |
| 17 | " | 10 | 0.9 | 20 | Invention |
| 18 | " | 20 | 0.6 | ≦5 | " |
| 19 | " | 30 | 0.2 | ≦5 | " |
| 20 | (II) | 10 | 0.2 | ≦5 | " |
| 21 | " | 20 | 0.1 | ≦5 | " |

It can be seen from the results in Table 2 that desilvering proceeds more rapidly by removing color developing agent in the light-sensitive material prior to bleaching by, for example, washing with water.

While the invention has been described in detail and with reference to specific embodiments thereof, it will be apparent to one skilled in the art that various changes and modifications can be made therein without departing from the spirit and scope thereof.

What is claimed is:

1. A method for desilvering an imagewise exposed and color development processed silver halide color light-sensitive material comprising the step of continuously processing the imagewise exposed and color developed silver halide color light-sensitive material with a processing solution having a pH of 8 to 11 and having a bleaching ability which contains as a bleaching agent at least one of hydrogen peroxide and a compound capable of releasing hydrogen peroxide, wherein said color development comprises processing in a color developer containing a color developing agent, said silver halide color light-sensitive material has an emulsion layer comprising a light-sensitive silver halide containing at least 90 mol % silver chloride and less than 1 mol % silver iodide, said processing solution having a bleaching ability contains at least one water-soluble chloride in an amount of from 0.01 to 0.1 mol/l, and said color developed silver halide color light-sensitive material contains 0.6 mmol/m$^2$ or less of said color developing agent when introduced into the processing solution having a bleaching ability; wherein said processing solution having a bleaching ability further contains in an amount of 10 mg to 50 g/l of at least one organic phosphonic acid or an alkali metal salt thereof represented by the following formula (I) or (II):

$$R_1N(CH_2PO_3M_2)_2 \quad (I)$$

wherein M represents a hydrogen atom or a cation imparting water solubility; and $R_1$ represents an alkyl group having from 1 to 4 carbon atoms, an aryl group, an aralkyl group, an alicyclic group, or a heterocyclic group, each of which may be substituted with a hydroxyl group, an alkoxy group, a halogen atom, $—PO_3M_2$, $—CH_2PO_3M_2$, or $—N(CH_2PO_3M_2)_2$, wherein M is as defined above, $$R_2R_3C(PO_3M_2)_2 \quad (II)$$

wherein M is as defined above; $R_2$ represents a hydrogen atom, an alkyl group, an aralkyl group, an alicyclic group, a heterocyclic group, $—CHR_4—PO_3M_2$, wherein M is as defined above; and $R_4$ represents a hydrogen atom, a hydroxyl group or an alkyl group, or $—PO_3M_2$ wherein M is as defined above; and $R_3$ represents a hydrogen atom, hydroxyl group, an alkyl group, or a substituted alkyl group or $—PO_3M_2$ wherein M is as defined above.

2. A method as claimed in claim 1, wherein said water-soluble chloride is represented by formula $M^+Cl-$ wherein $M^+$ is an alkali metal cation, an alkaline earth metal cation, or a quaternary $N^+$ group.

3. A method as claimed in claim 1, wherein said organic phosphonic acid or a salt thereof is present in the processing solution having a bleaching ability in an amount of from 10 mg/l to 50 g/l.

4. A method as claimed in claim 1, wherein the amount of the color developing agent contained in said color developed silver halide color light-sensitive material is 0.3 mmol/m$^2$ or less.

5. A method as claimed in claim 1, wherein said water-soluble chloride is sodium chloride or potassium chloride.

6. A method as claimed in claim 1, wherein said processing solution having a bleaching ability is a bleach-fix solution.

7. A method as claimed in claim 1, wherein said desilvering is completed within 30 seconds.

8. A method as claimed in claim 1, wherein the processing solution having a bleaching ability contains as a bleaching agent at least one of hydrogen peroxide and a compound capable of releasing hydrogen peroxide in an amount of from 0.03 to 6 mol/l.

9. A method as claimed in claim 1, wherein the processing solution having a bleaching ability contains as a bleaching agent at least one of hydrogen peroxide and a compound capable of releasing hydrogen peroxide in an amount of from 0.1 to 1.5 mol/l.

10. A method as claimed in claim 1, wherein said emulsion layer comprises a light-sensitive silver halide containing at least 98 mol % silver chloride.

11. A method as claimed in claim 1, wherein said emulsion layer comprises a light-sensitive silver halide containing not more than 0.2 mol % silver iodide.

12. A method as claimed in claim 1, wherein said desilvering is carried out for 10 to 30 seconds.

13. A method as claimed in claim 1, wherein the at least one organic phosphonic acid or an alkali metal salt thereof is represented by formula (I).

14. A method as claimed in claim 1, wherein the at least one organic phosphonic acid or an alkali metal salt thereof is represented by formula (II).

15. A method for desilvering an imagewise exposed and color development processed silver halide color light-sensitive material comprising the step of continuously processing the imagewise exposed and color developed silver halide color light-sensitive material with a processing solution having a pH of 8 to 11 and having a bleaching ability which contains as a bleaching agent at least one of hydrogen peroxide and a compound capable of releasing hydrogen peroxide, wherein said color development comprises processing in a color developer containing a color developing agent, said silver halide color light-sensitive material has an emulsion layer comprising a light-sensitive silver halide containing at least 90 mol % silver chloride and less than 1 mol % silver iodide, said processing solution having a bleaching ability contains at least one water-soluble chloride in an amount of from 0.01 to 0.1 mol/l, said method further comprising washing the color developed silver halide color light-sensitive material to control the content of the color developing agent in the color developed silver halide color light-sensitive material prior to processing in the processing solution having a bleaching ability to an amount of 0.6 mmol/$m^2$ or less; wherein said processing solution having a bleaching ability further contains in an amount of 10 mg to 50 g/l of at least one organic phosphonic acid or an alkali metal thereof represented by formula (I) or (II) as defined above.

* * * * *